US009798272B2

(12) United States Patent
Nakajima et al.

(10) Patent No.: US 9,798,272 B2
(45) Date of Patent: Oct. 24, 2017

(54) IMAGE FORMING APPARATUS

(71) Applicant: FUJI XEROX CO., LTD., Tokyo (JP)

(72) Inventors: Gen Nakajima, Yokohama (JP); Tetsuya Furuyama, Yokohama (JP); Kazunari Yamagishi, Yokohama (JP); Yoshiaki Haginoya, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/250,318

(22) Filed: Aug. 29, 2016

(65) Prior Publication Data

US 2017/0269512 A1 Sep. 21, 2017

(30) Foreign Application Priority Data

Mar. 16, 2016 (JP) ..... 2016-052921

(51) Int. Cl.
*G03G 15/16* (2006.01)
*G03G 21/00* (2006.01)

(52) U.S. Cl.
CPC ..... *G03G 15/161* (2013.01); *G03G 21/00* (2013.01)

(58) Field of Classification Search
CPC ..... G03G 15/161; G03G 21/00
USPC ..... 399/316
See application file for complete search history.

(56) References Cited

U.S. PATENT DOCUMENTS 3,866,573 A * 2/1975 Szostak ..... G03G 15/167 399/107
2010/0008687 A1* 1/2010 Ishii ..... G03G 15/169 399/55

FOREIGN PATENT DOCUMENTS

JP 2003-186258 A 7/2003
JP 2013-182139 A 9/2013

* cited by examiner

*Primary Examiner* — Quana M Grainger
(74) *Attorney, Agent, or Firm* — Oliff PLC

(57) ABSTRACT

An image forming apparatus includes an image carrier that carries an image, a transfer body that transports a recording medium in a contact region between the image carrier and the transfer body, a pair of transport members that are disposed upstream of the contact region in a transport direction, and transport the recording medium to the contact region, a guide member that includes, between the contact region and the pair of transport members, a portion on a downstream side in the transport direction which serves as a free end portion and a portion on an upstream side in the transport direction which is supported in a cantilever state, that guides a non-transfer surface of the recording medium, that is elastically deformed, and that has a cutout, and a detection unit that detects an image on an outer peripheral surface of the image carrier on a optical path.

20 Claims, 21 Drawing Sheets

IMAGE FORMING APPARATUS

CROSS-REFERENCE TO RELATED APPLICATIONS

This application is based on and claims priority under 35 USC 119 from Japanese Patent Application No. 2016-052921 filed Mar. 16, 2016.

BACKGROUND

Technical Field

The present invention relates to an image forming apparatus.

SUMMARY

According to an aspect of the invention, an image forming apparatus includes: an image carrier that carries an image; a transfer body that transports a recording medium in a contact region between the image carrier and the transfer body with the recording medium being interposed therebetween, and transfers the image to the recording medium; a pair of transport members that are disposed upstream of the contact region in a transport direction, and transport the recording medium to the contact region; a guide member that includes, between the contact region and the pair of transport members, a portion on a downstream side in the transport direction which serves as a free end portion and a portion on an upstream side in the transport direction which is supported in a cantilever state, that guides a non-transfer surface of the recording medium, that is elastically deformed toward transfer body with respect to the image carrier by being pushed by the non-transfer surface of the recording medium, and that has a cutout; and a detection unit that is disposed on an opposite side to the image carrier with respect to the guide member, and that detects an image on an outer peripheral surface of the image carrier on a optical path that passes through the cutout of the guide member in a non-deformed state.

BRIEF DESCRIPTION OF THE DRAWINGS

Exemplary embodiments of the present invention will be described in detail based on the following figures, wherein.

DETAILED DESCRIPTION

Hereinafter, exemplary embodiments according to the present invention will be described with reference to the drawings.

First Exemplary Embodiment (Image Forming Apparatus 10)

Figure 1:
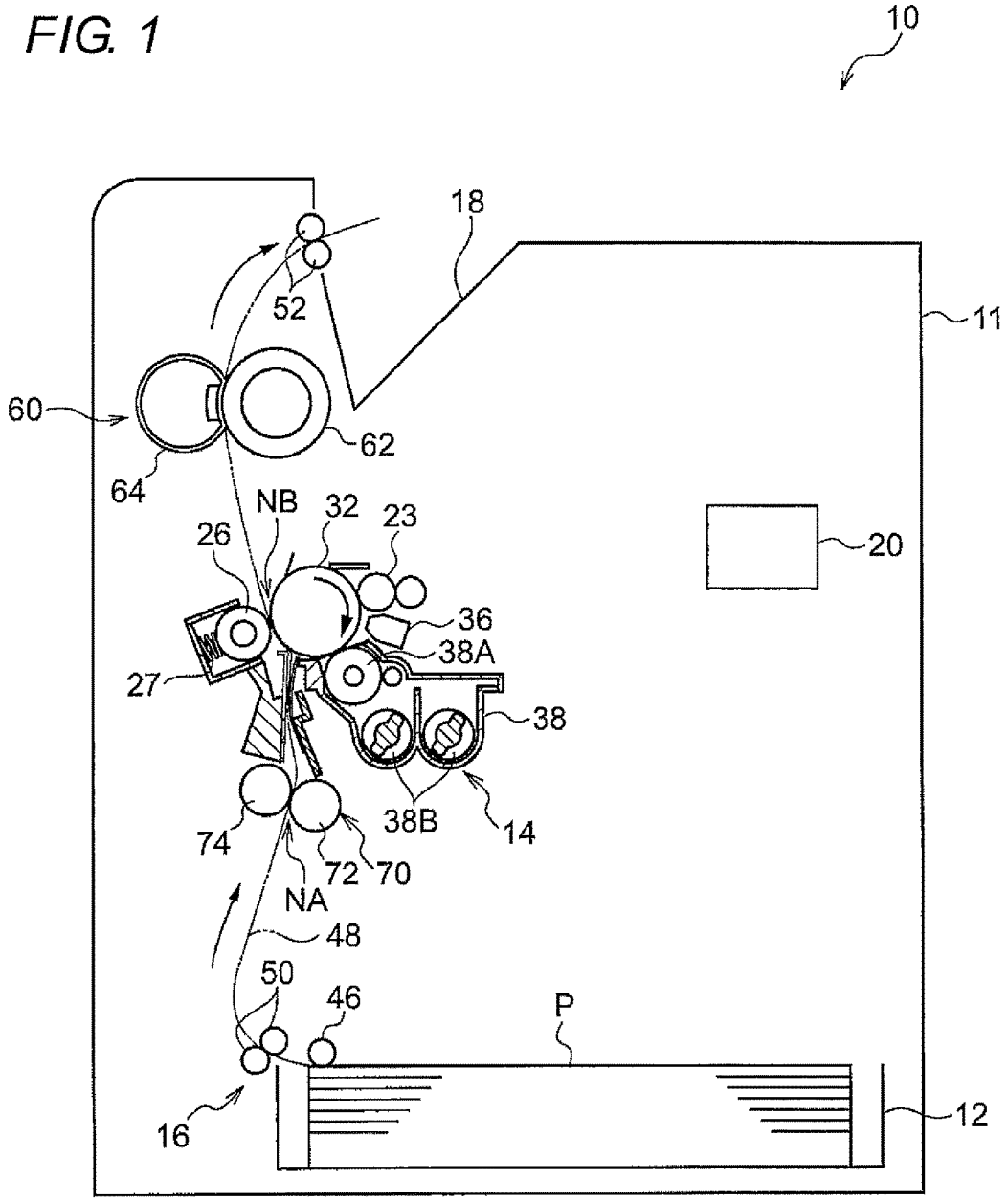
FIG. 1 is a schematic view illustrating a configuration of an image forming apparatus according to a first exemplary embodiment.

First, a configuration of an image forming apparatus 10 will be described. FIG. 1 is a schematic view illustrating a configuration of the image forming apparatus 10.

As illustrated in FIG. 1, the image forming apparatus 10 includes an apparatus main body (case) 11 in which respective constituent components are provided. The apparatus main body 11 is provided with an accommodating unit 12 which accommodates paper P (an example of a recording medium), an image forming unit 14 which forms an image on the paper P, a transport unit 16 which transports the paper P from the accommodating unit 12 to the image forming unit 14, and a controller 20 which controls operations of respective units of the image forming apparatus 10. In addition, an exit section 18, which dispenses the paper P on which the image is formed by the image forming unit 14, is provided on an upper side of the apparatus main body 11.

The image forming unit 14 includes a photoconductor drum 32 (an example of an image carrier) which carries a toner image (an example of an image) thereon. The photoconductor drum 32 is configured to rotate in a single direction (e.g., clockwise in FIG. 1). Around the photoconductor drum 32, there are provided, in order from an upstream side in a rotation direction of the photoconductor drum 32, a charging roll 23 as a charging device which charges the photoconductor drum 32, an exposure device 36 which exposes the photoconductor drum 32 charged by the charging roll 23 and forms an electrostatic latent image on the photoconductor drum 32, a developing device 38 which develops the electrostatic latent image formed on the photoconductor drum 32 by the exposure device 36, and forms the toner image, and a transfer roll (an example of a transfer body) 26 which transfers, to the paper P, the toner image formed on the photoconductor drum 32 by the developing device 38.

The developing device 38 includes a developer feeder 38A which supplies a developer to the photoconductor drum 32 at a predetermined development position (a position opposite to the photoconductor drum 32), and plural transport members 38B which transport the developer while agitating the developer supplied from the developer feeder 38A. In addition, the image forming apparatus 10 includes a toner cartridge (not illustrated) as an accommodating unit which accommodates toner to be supplied to the developing device 38, and a toner supply mechanism 39 (see FIG. 7) which transports the toner from the toner cartridge to the developing device 38 to supply the toner to the developing device 38.

The exposure device 36 is configured to form an electrostatic latent image based on an image signal sent from the controller 20. The image signal sent from the controller 20 includes, for example, an image signal obtained by the controller 20 from external devices.

The transfer roll 26 is in contact with (pressed against) the photoconductor drum 32 by a coil spring 27. Therefore, the transfer roll 26 rotates following the photoconductor drum 32. The transfer roll 26 rotates together with the photoconductor drum 32, and transports upward the paper P positioned between the transfer roll 26 and the photoconductor drum 32 in a contact region NB (nip region) with the photoconductor drum 32.

A transfer voltage (transfer electric current) having an opposite polarity to a toner polarity is applied to the transfer roll 26. Therefore, a transfer electric field is formed between the photoconductor drum 32 and the transfer roll 26 such that electrostatic force is applied to the toner image formed on the photoconductor drum 32 and held by the photoconductor drum 32 in the contact region NB, and the toner image is transferred to a transfer surface of the paper P. In the present specification, one surface of the paper P onto which the toner image is transferred is referred to as a transfer surface, and a surface (the other surface) opposite to the transfer surface is referred to as a non-transfer surface.

The transport unit 16 is provided with a delivery roll 46 which delivers the paper P accommodated in the accommodating unit 12, a transport path 48 through which the paper P delivered by the delivery roll 46 is transported, a transport roll pair 50 which is provided downstream of the delivery roll 46 in the transport direction and transports the paper P delivered by the delivery roll 46 to the downstream side (a contact region NA to be described below), and a registration roll pair 70 (an example of a pair of transport members) which transports, to the contact region NB, the paper P transported by the transport roll pair 50.

Specifically, the registration roll pair 70 has a registration roll 72 which comes into contact with the transfer surface of the paper P, and a pinch roll 74 which comes into contact with the non-transfer surface of the paper P. The registration roll 72 is rotated by a drive unit (not illustrated). The pinch roll 74 is in contact with (pressed against) the registration roll 72 by an elastic body (not illustrated) such as a coil spring. Therefore, the pinch roll 74 rotates following the registration roll 72.

Further, the registration roll pair 70 transports the paper P upward in a state in which the paper P is positioned between the registration roll 72 and the pinch roll 74 in the contact region NA between the registration roll 72 and the pinch roll 74. In addition, the registration roll pair 70 is configured to transport the paper P to the contact region NB at predetermined timing so that a transfer position (transfer initiation position) at which the toner image is transferred from the photoconductor drum 32 is matched with a position (leading end position) of the paper P.

A fixing device 60 is provided on the upper side (the downstream side in the transport direction) of the contact region NB to fix the toner image, which is transferred to the paper P by the transfer roll 26, to the paper P. The fixing device 60 includes a heating roll 62 and a pressure roll 64. The fixing device 60 is configured to fix the toner image, which is transferred to the paper P, to the paper P by a heating operation of the heating roll 62 and a pressing operation of the pressure roll 64. Exit rolls 52, which discharge the paper P having the toner image fixed thereto to the exit section 18, are provided on the upper side (the downstream side in the transport direction) of the fixing device 60.

(Image Forming Operation)

Next, descriptions will be made on an image forming operation of the image forming apparatus 10, which forms an image on the paper P.

In the image forming apparatus 10, the paper P, which is delivered from the accommodating unit 12 by the delivery roll 46, is transported into the contact region NB by the transport roll pair 50 and the registration roll pair 70.

Meanwhile, in the image forming unit 14, the photoconductor drum 32 is charged by the charging roll 23, and then exposed by the exposure device 36 such that an electrostatic latent image is formed on the photoconductor drum 32. The electrostatic latent image is developed by the developing device 38, and the toner image is formed on the photoconductor drum 32. The toner image is transferred to the paper P by the transfer roll 26 in the contact region NB. As described above, in the first exemplary embodiment, the image formed on the photoconductor drum 32 is transferred to the paper P without using an intermediate transfer body.

The paper P to which the toner image is transferred is transported to the fixing device 60, and the toner image is fixed by the fixing device 60. The paper P to which the toner image is fixed is discharged to the exit section 18 by the exit rolls 52. As described above, a series of image forming operations are carried out.

(Specific Configuration Between Contact Region NA and Contact Region NB)

Next, a specific configuration between the contact region NA and the contact region NB in the image forming apparatus 10 will be described. Left and right sides used in the following description are right and left sides in FIGS. 2, 3, and 4. In addition, the left side is the transfer roll 26 side with respect to the photoconductor drum 32 or the pinch roll 74 side with respect to the registration roll 72. In addition, the right side is the photoconductor drum 32 side with respect to the transfer roll 26, or the registration roll 72 side with respect to the pinch roll 74.

Figure 2:
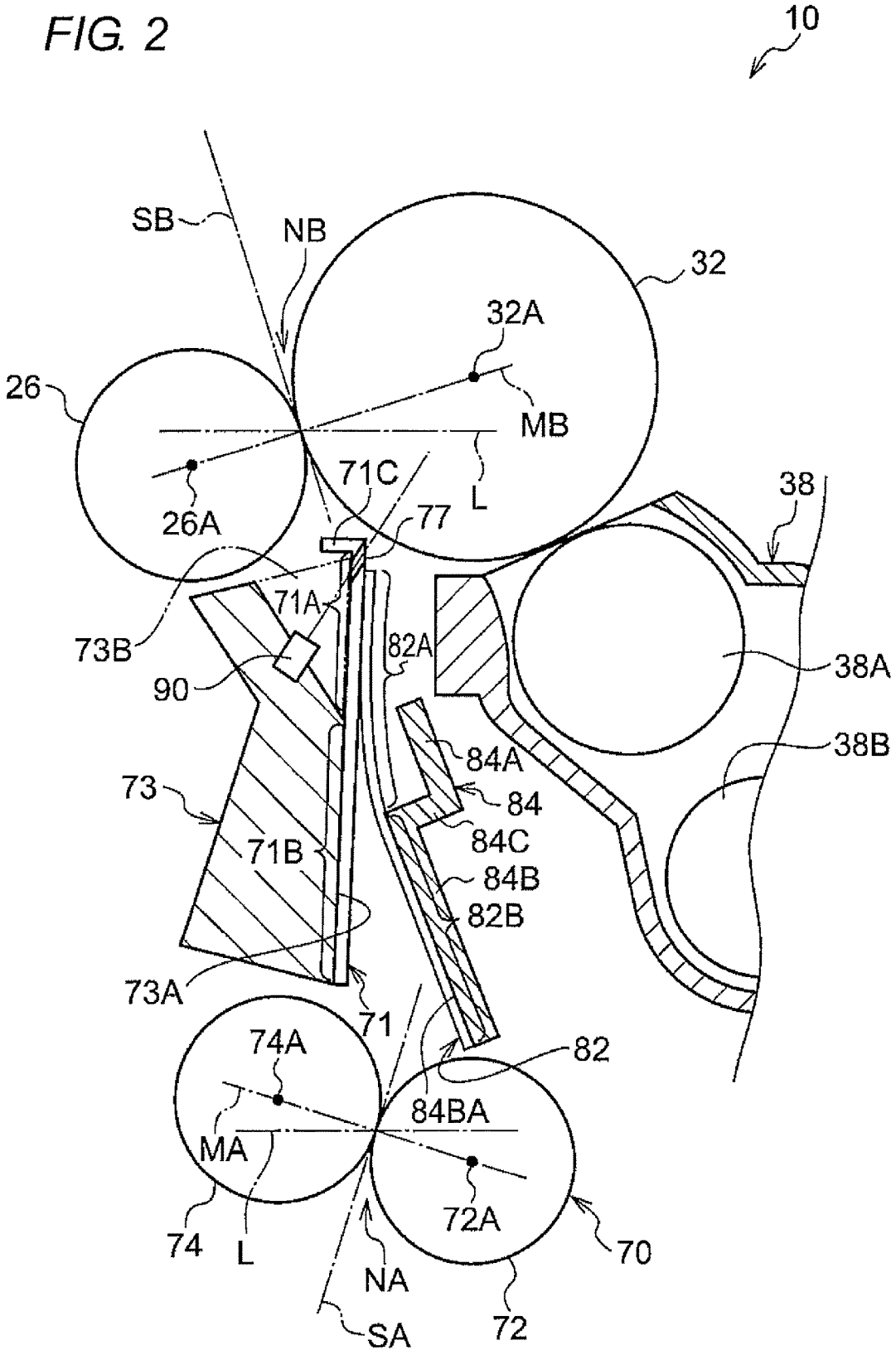
FIG. 2 is a schematic view illustrating a configuration between a photoconductor drum (transfer roll) and a registration roll pair according to the first exemplary embodiment.

As illustrated in FIG. 2, the photoconductor drum 32 and the transfer roll 26 are disposed such that an axial center 32A of the photoconductor drum 32 is located at a position higher than an axial center 26A of the transfer roll 26. That is, a line MB, which connects the axial center 32A of the photoconductor drum 32 and the axial center 26A of the transfer roll 26, has an angle with respect to a horizontal line L, and a tangential line SB, which passes through the contact region NB between the photoconductor drum 32 and the transfer roll 26, extends to the oblique upper left. The tangential line SB is a line orthogonal to the line MB.

The registration roll pair 70 is disposed such that the axial center 74A of the pinch roll 74 is located higher than the axial center 72A of the registration roll 72. That is, a line MA, which connects the axial center 72A and the axial center 74A of the registration roll pair 70, has an angle with respect to the horizontal line L, and a tangential line SA, which passes through the contact region NA of the registration roll pair 70, extends to the oblique upper right. The tangential line SA is a line orthogonal to the line MA.

Further, as illustrated in FIG. 2, the image forming apparatus 10 has a first transport guide 71 (an example of a guide member) which guides the non-transfer surface of the paper P, a support unit 73 which supports the first transport guide 71, a second transport guide 82 which guides the transfer surface of the paper P, and a support unit 84 which supports the second transport guide 82.

The first transport guide 71, the support unit 73, the second transport guide 82, and the support unit 84 are disposed between the contact region NA (the registration roll pair 70) and the contact region NB (the photoconductor drum 32 and the transfer roll 26). That is, the first transport guide 71, the support unit 73, the second transport guide 82, and the support unit 84 are disposed downstream of the contact region NA in the transport direction and upstream of the contact region NB in the transport direction.

Specifically, the support unit 73 is disposed on the left side with respect to the tangential line SA and the tangential line SB. The support unit 73 has a support surface 73A which supports the first transport guide 71. The support surface 73A is fixed to a lower portion 71B of the first transport guide 71 by bonding, thereby supporting the first transport guide 71. The support surface 73A is disposed on a lower side of the support unit 73 and faces to the right side. The support unit 73 has a cutout portion 73B to secure a space that elastically deforms the first transport guide 71. The cutout portion 73B is disposed on the upper side of the support surface 73A.

The first transport guide 71 is formed in a plate shape having a predetermined width along an axial direction of the photoconductor drum 32 and the transfer roll 26. Specifically, the first transport guide 71 is made of an elastically deformable resin film formed of an electrically conductive resin material such as PET. For example, the first transport guide 71 has a volume resistance of $10^{14}$ Ω·cm or less and a surface resistance of $10^{14}$ Ω/cm$^2$ or less.

The lower portion 71B (an example of a portion on the upstream side in the transport direction) of the first transport guide 71 is supported on the support surface 73A of the support unit 73 in a cantilever state in which an upper portion 71A (an example of a portion on the downstream side in the transport direction) of the first transport guide 71 serves as a free end portion. Therefore, the upper portion 71A is configured to be elastically deformable (displaceable) leftward (see FIG. 4).

The first transport guide 71 is in contact with the second transport guide 82 in a paper non-passing state, and in this state, as illustrated in FIG. 2, the first transport guide 71 has a straight line shape along the support surface 73A in side view. In this state, at least an end portion of the upper portion 71A on the downstream side in the transport direction is disposed on the right side with respect to the tangential line SB. A bent portion 71C, which is bent leftward, is formed at the end portion of the upper portion 71A on the downstream side in the transport direction.

Figure 5:
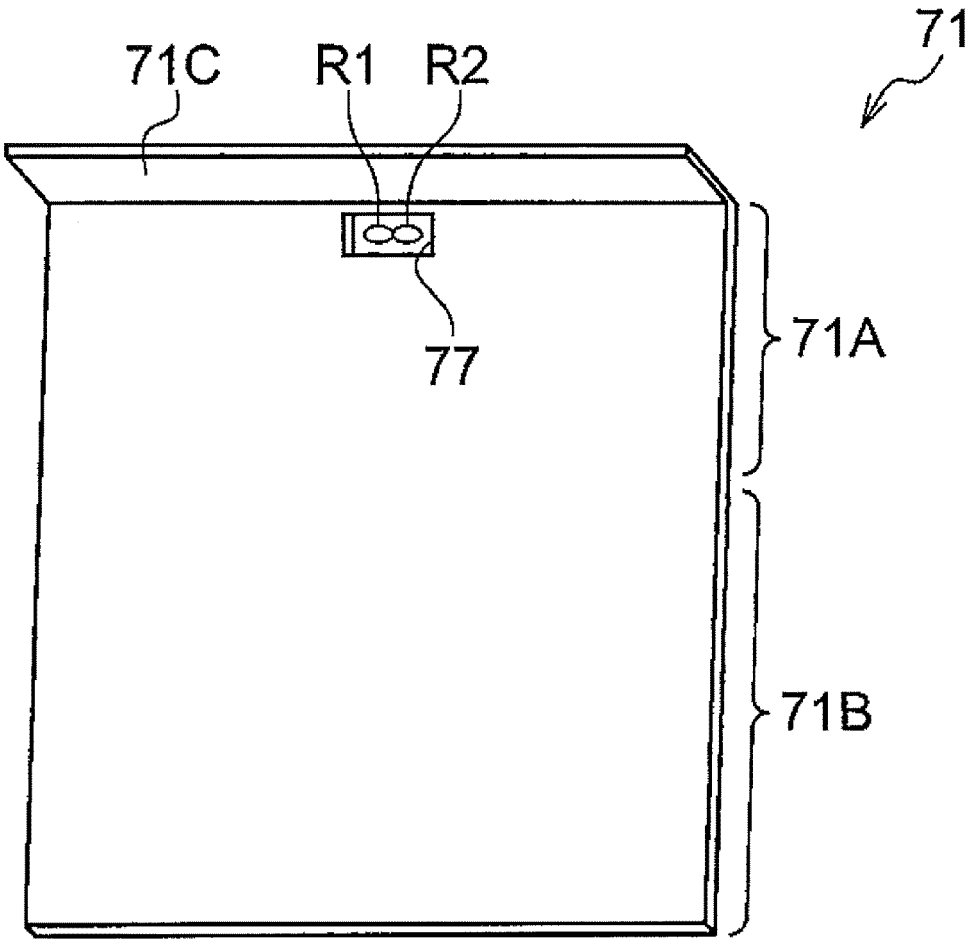
FIG. 5 is a schematic perspective view illustrating a configuration of a first transport guide according to the first exemplary embodiment.

As illustrated in FIGS. 5 and 2, a through hole 77 (an example of a cutout) is formed at a central portion, in a width direction, of the upper portion 71A of the first transport guide 71. The through hole 77 penetrates the first transport guide 71 in the thickness direction. The through hole 77 is formed on an upper side (free end) further displaced from a lower side (a support point side) of the upper portion 71A.

As illustrated in FIG. 2, the support unit 84 is configured with a plate body formed in the form of a crank in side view. Specifically, the support unit 84 has an upper portion 84A (a portion on the downstream side in the transport direction) which extends to the oblique upper left in side view, a lower portion 84B (a portion on the upstream side in the transport direction) which extends to the oblique upper left in side view, and an intermediate portion 84C which connects a lower end of the upper portion 84A and an upper end of the lower portion 84B.

The lower portion 84B has a support surface 84BA which supports the second transport guide 82. The support surface 84BA supports the second transport guide 82 as a lower portion 82B of the second transport guide 82 is fixed by bonding or the like.

The second transport guide 82 is formed in a plate shape having a predetermined width along an axial direction of the photoconductor drum 32 and the transfer roll 26. Specifically, like the first transport guide 71, the second transport guide 82 is configured with an elastically deformable resin film formed of an electrically conductive resin material such as PET. For example, the second transport guide 82 has a volume resistance of $10^{14}$ Ω·cm or less, and a surface resistance of $10^{14}$ Ω/cm$^2$ or less.

An upper portion 82A (an example of a portion on the downstream side in the transport direction) of the second transport guide 82 serves as a free end portion, and a lower portion 82B (an example of a portion on the upstream side in the transport direction) of the second transport guide 82 is supported by the support surface 84BA of the support unit 84 in a cantilever state. Therefore, the upper portion 82A is configured to be elastically deformable (displaceable) rightward.

The second transport guide 82 has a larger deflection amount per unit load (an elastic modulus in a bending direction) than the first transport guide 71. As a result, the upper portion 82A of the second transport guide 82 is in contact with the upper portion 71A in a state in which the upper portion 82A of the second transport guide 82 is elastically deformed rightward and curved rightward by being pressed by the upper portion 71A of the first transport guide 71 (see FIG. 2).

Here, the deflection amount refers to a movement amount of the free ends (downstream ends in the transport direction) of the first transport guide 71 and the second transport guide 82 in the thickness direction in a case in which a predetermined load is applied, in the thickness direction, to the upper portion 71A of the first transport guide 71 and the upper portion 82A of the second transport guide 82.

In addition, when the upper portion 82A of the second transport guide 82 is deformed by a predetermined amount or more, the upper portion 84A of the support unit 84 abuts against the upper portion 82A and suppresses the upper portion 82A from being further deformed.

The lower portion 82B of the second transport guide 82 is supported by the support surface 84BA of the support unit 84 such that the lower portion 82B of the second transport guide 82 is disposed along the oblique upper left to traverse the tangential line SA of the registration roll pair 70 (a discharge direction in the contact region NA). For this reason, the paper P discharged from the contact region NA of the registration roll pair 70 comes into contact with the lower portion 82B of the second transport guide 82, and is guided to the first transport guide 71 by the lower portion 82B.

Figure 3:
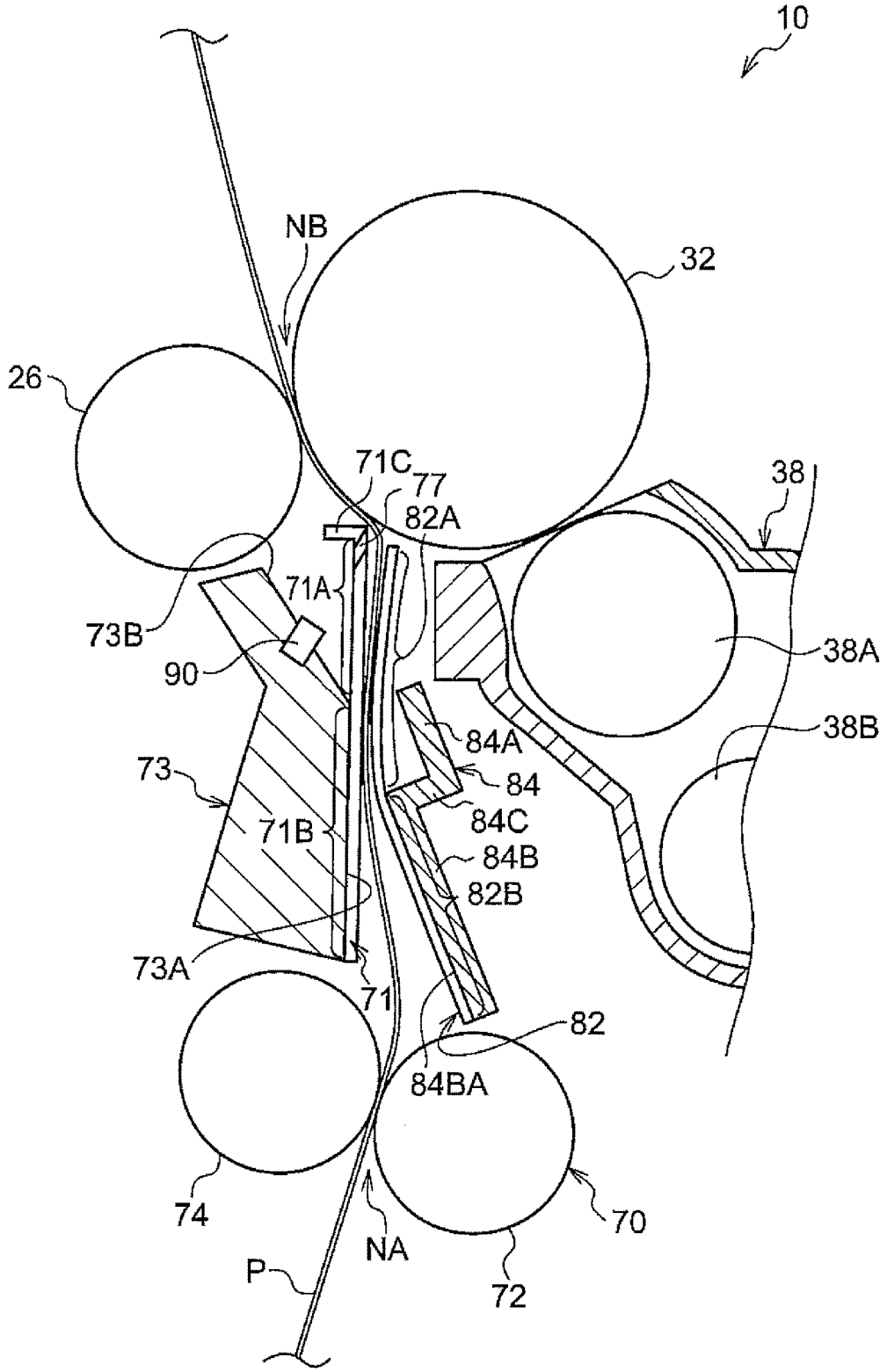
FIG. 3 is a schematic view illustrating a state in which plain paper is transported in the configuration illustrated in FIG. 2.

Further, in a case in which plain paper is transported as the paper P, the deflection amount per unit load is set such that the first transport guide 71 maintains a straight line shape along the support surface 73A in side view, or is elastically deformed slightly leftward by being pressed by the non-transfer surface of the plain paper (see FIG. 3).

In addition, even in a case in which the first transport guide 71 is elastically deformed slightly leftward by being pressed by the non-transfer surface of the plain paper, at least the end portion of the upper portion 71A on the downstream side in the transport direction is maintained to be located on the right side with respect to the tangential line SB.

As described above, the upper portion 71A of the first transport guide 71 is located on the right side with respect to the tangential line SB, and as illustrated in FIG. 3, the non-transfer surface of the plain paper is guided by the upper portion 71A so that the transfer surface of the plain paper comes into contact with an outer periphery of the photoconductor drum 32 upstream of the contact region NB in the transport direction.

Meanwhile, in a case in which plain paper is transported as the paper P, the second transport guide 82 guides the transfer surface of the plain paper in a state in which the second transport guide 82 is elastically deformed rightward by being pressed by the upper portion 71A of the first transport guide 71 via the plain paper.

Figure 4:
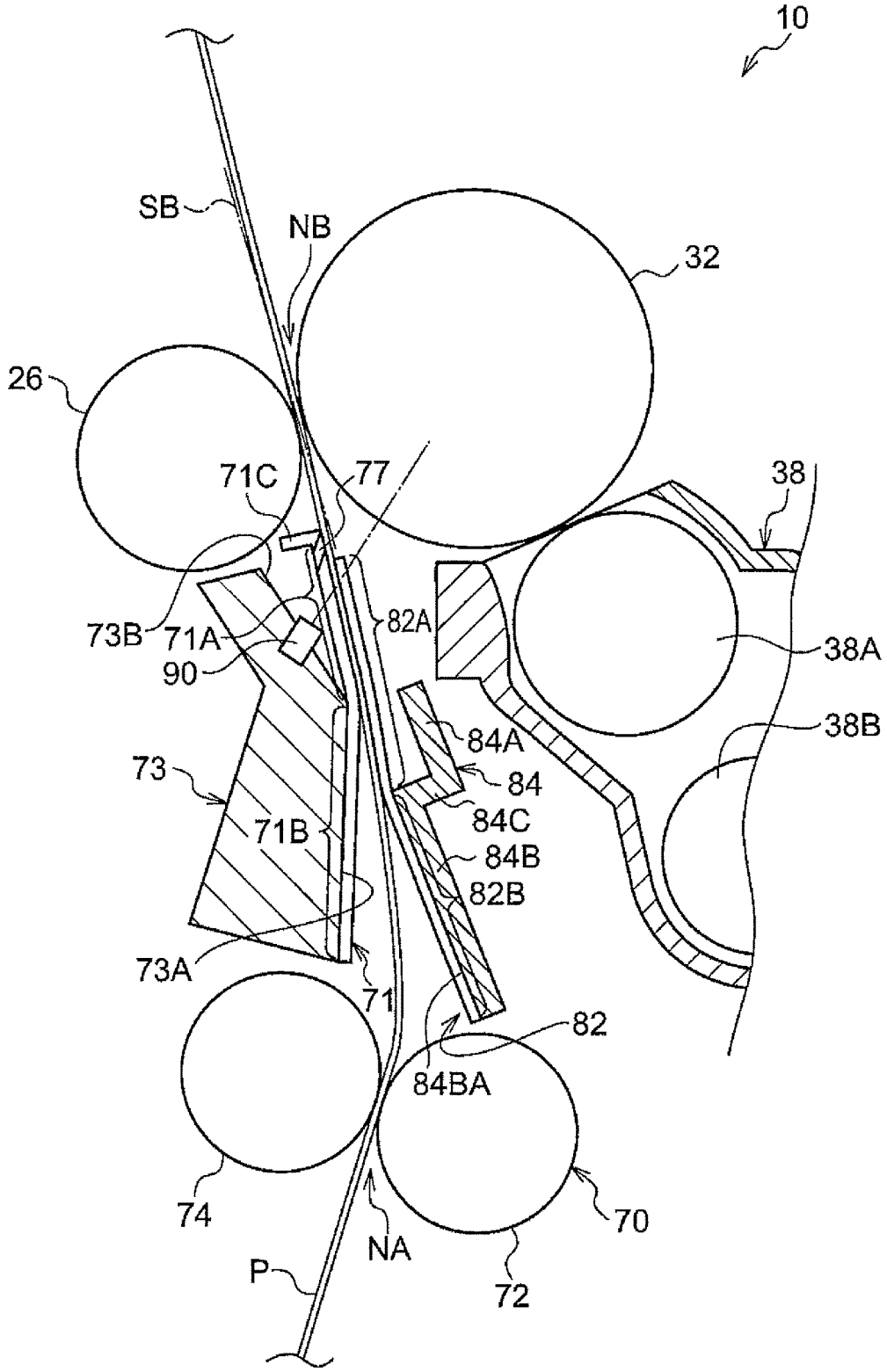
FIG. 4 is a schematic view illustrating a state in which thick paper is transported in the configuration illustrated in FIG. 2.

In addition, in a case in which thick paper is transported as the paper P, the deflection amount per unit load is set such that the upper portion 71A of the first transport guide 71 is elastically deformed along the tangential line SB by being pressed by the non-transfer surface of the thick paper as illustrated in FIG. 4. In addition, the upper portion 71A may not be deformed completely along the tangential line SB, and may be elastically deformed at least more leftward than the case in which the plain paper is transported.

Since the upper portion 71A of the first transport guide 71 is elastically deformed along the tangential line SB, the non-transfer surface of the thick paper is guided by the upper portion 71A so that the thick paper is introduced into (enters) the contact region NB in a direction along the tangential line SB.

Meanwhile, in a case in which thick paper is transported as the paper P, the second transport guide 82 is elastically restored leftward as the first transport guide 71 is elastically deformed leftward. In this state, the second transport guide 82 guides the transfer surface of the thick paper.

In addition, the elastic restoration includes a case in which the second transport guide 82 is released from the elastic deformation and returns to the original state, and a case in which the elastic deformation of the second transport guide 82 is still maintained and the elastic deformation amount thereof is decreased.

In addition, in the present specification, the plain paper refers to a paper having a basis weight of 52 g/m$^2$ or more and 105 g/m$^2$ or less, and the thick paper refers to a paper having a basis weight of more than 105 g/m$^2$ and 350 g/m$^2$ or less.

(Detection Sensor 90)

As illustrated in FIG. 2, the image forming apparatus 10 includes a detection sensor 90 (an example of a detection unit) which detects the toner image of the outer peripheral surface of the photoconductor drum 32. The detection sensor 90 is provided on an upper side of the support surface 73A of the support unit 73 and on the left side of the upper portion 71A of the first transport guide 71. Therefore, the detection sensor 90 is disposed on the opposite side to the photoconductor drum 32 with respect to the first transport guide 71. That is, the first transport guide 71 is disposed between the detection sensor 90 and the photoconductor drum 32.

Figure 6:
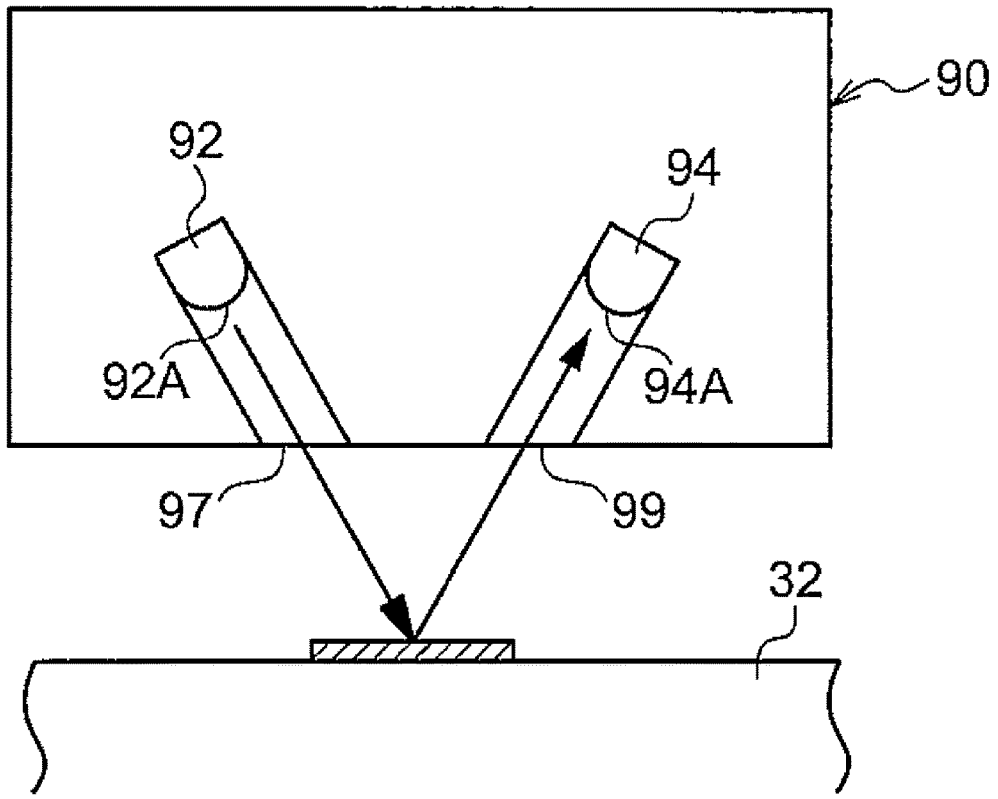
FIG. 6 is a schematic view illustrating a configuration of a detection sensor according to the first exemplary embodiment.

Specifically, the detection sensor 90 is configured as a reflective optical sensor which detects the toner image. As illustrated in FIG. 6, the detection sensor 90 has an irradiating unit 92 (a light emitting unit) which irradiates light from an irradiating surface 92A, and a light receiving unit 94 which receives reflected light reflected by the photoconductor drum 32 on a light receiving surface 94A. For example, a light emitting diode (LED) is used as the irradiating unit 92, and, for example, a photo diode (PD) is used as the light receiving unit 94.

In addition, the detection sensor 90 has a light emitting window 97 (an example of a light emission surface) from which the light irradiated from the irradiating unit 92 is emitted, and a light receiving window 99 (an example of a light incident surface) through which the reflected light enters the light receiving unit 94. The light emitting window 97 and the light receiving window 99 are configured with a transparent member that allows light to pass therethrough.

Further, in a state in which no paper passes between the first transport guide 71 and the second transport guide 82 (a state illustrated in FIG. 2), the detection sensor 90 detects an image on the outer peripheral surface of the photoconductor drum 32 in a optical path that passes through the through hole 77 of the first transport guide 71 in a state in which the first transport guide 71 is not deformed. That is, in the detection sensor 90, the light irradiated from the irradiating unit 92 passes through the through hole 77 and enters the outer peripheral surface of the photoconductor drum 32 from the development position to the contact region NB, and the reflected light reflected by the outer peripheral surface passes through the through hole 77 and enters the light receiving unit 94. In addition, in FIG. 5, R1 indicates the irradiated light of the detection sensor 90, and R2 indicates the reflected light of the detection sensor 90.

In addition, the size of the through hole 77 is set based on the size of light of the irradiating unit 92 or the focal length of the detection sensor 90. For example, in a case in which the diameter of light is 2 mm and the focal length is 20 mm, the size of the through hole 77 is, for example, about 3 mm×9 mm.

The upper portion 71A of the first transport guide 71 is configured to block the optical path of the detection sensor 90 when viewed from the photoconductor drum 32 in a state in which the upper portion 71A of the first transport guide 71 is elastically deformed by being pressed by the non-transfer surface of the thick paper (a state illustrated in FIG. 4). That is, the upper portion 71A of the first transport guide 71 covers the irradiating surface 92A and the light receiving surface 94A of the detection sensor 90 in a state in which the upper portion 71A of the first transport guide 71 is deformed.

The toner image detected by the detection sensor 90 is a non-transfer image which is formed separately from an image transferred to the paper P. For example, the toner image is a toner patch which is formed on the photoconductor drum 32 so as to be detected and is not transferred to the paper P.

The toner patch is formed on the photoconductor drum 32 at a predetermined timing, and detected by the detection sensor 90. Examples of the predetermined timing include a timing when electric power is applied to the image forming apparatus 10, a timing between a job (processing unit for an image forming operation which the controller 20 processes (performs) by receiving an image forming instruction) and another job, and a timing when the image forming operation of forming a transfer image is terminated.

Figure 7:
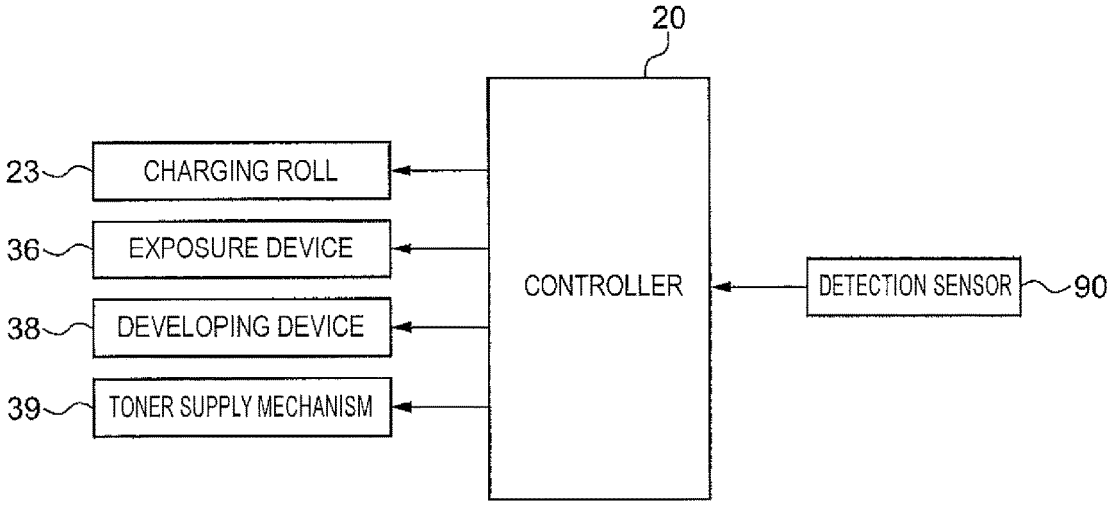
FIG. 7 is a block diagram illustrating a control system of the image forming apparatus according to the first exemplary embodiment.

In the first exemplary embodiment, the detection sensor 90 detects the toner patch and a bare surface of the photoconductor drum 32 on which no toner image is formed. As illustrated in FIG. 7, the detection sensor 90 is connected to the controller 20, and a result of detection by the detection sensor 90 is sent to the controller 20. In addition, the controller 20 is connected to the respective components of the image forming unit 14 (specifically, the charging roll 23, the exposure device 36, the developing device 38, and the toner supply mechanism 39 which supplies toner to the developing device 38). The controller 20 controls the respective components of the image forming unit 14 based on the result of detection by the detection sensor 90. A specific control operation by the controller 20 will be described below.

(Operation According to First Exemplary Embodiment)

Next, an operation according to the first exemplary embodiment will be described.

In the first exemplary embodiment, in a state in which no paper P passes between the first transport guide 71 and the second transport guide 82, the detection sensor 90 detects the toner patch and the bare surface on the photoconductor drum 32. A detection result of the toner patch and the bare surface by the detection sensor 90 is sent to the controller 20 as a bare surface output value and a patch output value. The controller 20 defines a ratio of the patch output value to the bare surface output value as an image density value, and controls the respective components of the image forming unit 14 based on a difference between the image density value and a target density value. Specifically, based on the difference between the image density value and the target density value, the controller 20 controls a charging potential of the charging roll 23, an exposure amount of the exposure device 36, a development potential of the developing device 38, the amount of toner supplied to the developing device 38, and so on. Therefore, the concentration of the toner image formed on the photoconductor drum 32 is maintained to be constant.

In addition, based on the difference between the image density value and the target density value, the controller 20 may determine whether the toner cartridge is vacant.

In the first exemplary embodiment, the image on the outer peripheral surface of the photoconductor drum 32 is detected on the optical path that passes through the through hole 77 of the first transport guide 71 in a state in which the first transport guide 71 is not deformed. That is, in the detection sensor 90, the light irradiated from the irradiating unit 92 passes through the through hole 77 and enters the outer peripheral surface of the photoconductor drum 32 from the development position to the contact region NB, and the reflected light reflected by the outer peripheral surface passes through the through hole 77 and enters the light receiving unit 94.

Here, in the configuration (comparative example) in which the light irradiated from the irradiating unit 92 and the reflected light directed toward the light receiving unit 94 penetrate the first transport guide 71, when a penetration position of the first transport guide 71 is contaminated, it may difficult for the irradiated light and the reflected light to penetrate the first transport guide 71, and an image detection defect may occur.

In contrast, in the first exemplary embodiment, the detection is carried out by using the irradiated light and the reflected light, which pass through the through hole 77 of the first transport guide 71. Thus, the irradiated light and the reflected light are hardly blocked due to a contaminant attached to the first transport guide 71 and an image detection defect is suppressed, compared to the aforementioned comparative example.

In the first exemplary embodiment, when plain paper as the paper P enters the contact region NA of the registration roll pair 70, the plain paper is transported to the second transport guide 82 by the registration roll pair 70. The plain paper transported to the second transport guide 82 is guided to the first transport guide 71 along the oblique upper left by the lower portion 82B of the second transport guide 82.

As illustrated in FIG. 3, the plain paper guided to the first transport guide 71 is guided by the upper portion 71A of the first transport guide 71 so that the transfer surface comes into contact with the outer periphery of the photoconductor drum 32 upstream side of the contact region NB in the transport direction.

Therefore, the plain paper enters the contact region NB after the transfer surface comes into contact with the outer periphery of the photoconductor drum 32. As the plain paper enters the contact region NB, the leading end side of the plain paper is sandwiched between the photoconductor drum 32 and the transfer roll 26 in the contact region NB, and the trailing end side is sandwiched between the registration rolls of the registration roll pair 70 in the contact region NA. Even in this state, the plain paper is guided by the upper portion 71A of the first transport guide 71 so that the transfer surface comes into contact with the outer periphery of the photoconductor drum 32 upstream of the contact region NB in the transport direction.

Here, in the configuration in which the plain paper enters the contact region NB in a direction along the tangential line SB (first comparative example), a gap is formed between the photoconductor drum 32 and the plain paper upstream of the contact region NB in the transport direction. Therefore, electric charge of the transfer roll 26 (electric charge having an opposite polarity to a toner polarity) is discharged to the photoconductor drum 32 through the gap, and a part of the toner image formed on the photoconductor drum 32 is charged to have reverse polarity. When a part of the toner image is charged to have the opposite polarity, the part of the toner image is not transferred to the plain paper, and a transfer defect may occur. In particular, since the transfer roll 26 and the photoconductor drum 32 have a cylindrical shape, the distance between the paper and the photoconductor drum is easily increased upstream of the contact region NB in the transport direction, compared to a case in which the paper is brought into close contact with an intermediate transfer belt and then transported to the contact region NB. As the distance is increased, electric charge is easily discharged between the paper and the photoconductor drum.

In contrast, in the first exemplary embodiment, since the plain paper enters the contact region NB after the transfer surface comes into contact with the outer periphery of the photoconductor drum 32, a gap is hardly formed between the photoconductor drum 32 and the plain paper, and the transfer defect is suppressed, as compared to the first comparative example.

In addition, in the first exemplary embodiment, in a case in which plain paper is transported as the paper P, the second transport guide 82 guides the transfer surface of the plain paper in a state in which the second transport guide 82 is elastically deformed rightward by being pressed by the upper portion 71A of the first transport guide 71 via the plain paper.

In this case, the second transport guide 82 guides the transfer surface of the plain paper by pressing the plain paper against the first transport guide 71. Therefore, because the plain paper is not excessively curved (bent) rightward upstream of the contact region NB in the transport direction, a transport load is not excessively increased.

In addition, since the second transport guide 82 comes into contact with the plain paper, a small distance is maintained between the first transport guide 71 and the second transport guide 82. For this reason, entrance of foreign matters (e.g., toner) is suppressed between the first transport guide 71 and the second transport guide 82, that is, in the transport path. In addition, since the second transport guide 82 comes into contact with the plain paper, the transfer surface of the plain paper is not exposed so that the foreign matters are suppressed from being attached to the transfer surface of the plain paper.

Meanwhile, when the thick paper as the paper P enters the contact region NA of the registration roll pair 70, the thick paper is transported to the second transport guide 82 by the registration roll pair 70. The thick paper transported to the second transport guide 82 is guided to the first transport guide 71 along the oblique upper left by the lower portion 82B of the second transport guide 82.

As illustrated in FIG. 4, the upper portion 71A of the first transport guide 71 is elastically deformed along the tangential line SB by being pressed by the non-transfer surface of the thick paper guided by the first transport guide 71. That is, the first transport guide 71 is elastically deformed leftward from the state illustrated in FIG. 3 in which the first transport guide 71 guides the plain paper.

Since the upper portion 71A of the first transport guide 71 follows the tangential line SB, the non-transfer surface of the thick paper guided by the first transport guide 71 is guided by the upper portion 71A to enter the contact region NB in a direction following the tangential line SB. As the thick paper enters the contact region NB, the leading end side of the thick paper is sandwiched between the photoconductor drum 32 and the transfer roll 26 in the contact region NB, and the trailing end side of the thick paper is sandwiched between the registration roll pair 70 in the contact region NA. Even in this state, the upper portion 71A of the first transport guide 71 is maintained in the state of being elastically deformed along the tangential line SB, and the thick paper enters the contact region NB in a direction following the tangential line SB.

In a case in which thick paper is used as the paper P as described above, the thick paper enters the contact region NB in a direction following the tangential line SB. Therefore, vibration caused by impact applied to the photoconductor drum 32 is mitigated, compared to a configuration in which the thick paper comes into contact with the outer periphery of the photoconductor drum 32 and then enters the contact region NB (second comparative example). Therefore, cross stripes (banding) caused by vibration of the photoconductor drum 32 are suppressed from being formed on the toner image, compared to the second comparative example.

In addition, since the thick paper enters the contact region NB in the direction following the tangential line SB, a transport load acting on the thick paper is reduced, and a variation in speed occurring when the thick paper exits the contact region NA is decreased, compared to the second comparative example.

In addition, even with the thick paper, the aforementioned transfer defect may occur because a gap is formed between the thick paper and the photoconductor drum 32 upstream of the contact region NB in the transport direction. However, since an image defect caused by the cross stripes is more noticeable as an image defect than that caused by the transfer defect, cross stripes are preferentially suppressed.

In addition, the upper portion 71A of the first transport guide 71 blocks the optical path of the detection sensor 90 by being elastically deformed leftward by being pressed by the non-transfer surface of the thick paper. That is, the upper portion 71A covers the irradiating surface 92A and the light receiving surface 94A of the detection sensor 90 in the deformed state.

Therefore, the irradiating surface 92A and the light receiving surface 94A of the detection sensor 90 are suppressed from being contaminated by toner or the like, compared to a configuration (comparative example) in which the irradiating surface 92A and the light receiving surface 94A are exposed even in the state in which the upper portion 71A is deformed.

In addition, in the first exemplary embodiment, the through hole 77 is formed at the central portion, in the width direction, of the first transport guide 71. Here, in a configuration in which a cutout such as the through hole 77 is formed only at one end, in the width direction, of the first transport guide 71 (third comparative example), the first transport guide 71 may be elastically deformed in a biased manner at one end in the width direction and deformation amounts may vary at the one end and the other end in the width direction. In this case, the paper P may be transported to skew.

In contrast, in the first exemplary embodiment, since the through hole 77 is formed at the central portion of the first transport guide 71 in the width direction, the first transport guide 71 is suppressed from being elastically deformed in the biased manner at one end in the width direction, and thus the paper is suppressed from skewing, compared to the third comparative example.

In addition, in the first exemplary embodiment, the second transport guide 82 is elastically restored leftward, as the first transport guide 71 is elastically deformed leftward. In this state, the second transport guide 82 guides the transfer surface of the thick paper.

As described above, since the second transport guide 82 is elastically restored leftward as the first transport guide 71 is elastically deformed leftward, a small distance is maintained between the first transport guide 71 and the second transport guide 82, compared to a configuration in which the second transport guide 82 is made of a rigid body (the second transport guide 82 is not elastically deformed) (fourth comparative example). For this reason, the entrance of foreign matters (e.g., toner or the like) is suppressed between the first transport guide 71 and the second transport guide 82, that is, in the transport path.

In addition, since the second transport guide 82 guides the transfer surface of the thick paper in a state in which the second transport guide 82 is elastically restored leftward, the transfer surface of the thick paper is not exposed, and thus foreign matters are suppressed from being attached to the transfer surface of the thick paper, compared to the fourth comparative example.

In addition, in the first exemplary embodiment, the bent portion 71C, which is bent leftward, is formed on the end portion, on the downstream side in the transport direction, of the upper portion 71A of the first transport guide 71. Therefore, since paper P (including plain paper and thick paper) passes through the first transport guide 71 while the trailing end of the paper P comes into contact with the bent portion 71C, the trailing end is suppressed from jumping, compared to a configuration in which the end portion of the first transport guide 71 on the downstream side in the transport direction is formed in a straight line shape (fifth comparative example). Therefore, in the first exemplary embodiment, a transfer defect of a toner image to the paper P caused by the jumping of the trailing end is suppressed, compared to the fifth comparative example.

In addition, since the first transport guide 71 is made of an elastically deformable resin film, the bent portion 71C is bent by a contact between the rear end and the bent portion 71C, and a period of time for which the rear end and the bent portion 71C are in contact with each other is increased as the bent portion 71C is bent. Thus the jumping of the trailing end is effectively suppressed, compared to a case in which the bent portion 71C is not bent.

In addition, in the first exemplary embodiment, the first transport guide 71 and the second transport guide 82 are electrically conductive. Specifically, the first transport guide 71 and the second transport guide 82 have a volume resistance of $10^{14}$ Ω·cm or less, and a surface resistance of $10^{14}$ Ω/cm$^2$ or less.

Here, in a case in which the first transport guide 71 and the second transport guide 82 have electric insulation properties, specifically, in a case in which the first transport guide 71 and the second transport guide 82 have volume resistance of more than $10^{14}$ Ω·cm, and surface resistance of more than $10^{14}$ Ω/cm$^2$ (sixth comparative example), the first transport guide 71 and the second transport guide 82 are easily charged due to the friction with the paper. When the first transport guide 71 and the second transport guide 82 are charged, the first transport guide 71 and the second transport guide 82 may electrostatically attract toner such that the attracted toner may be attached onto the paper.

In contrast, in the first exemplary embodiment, since the first transport guide 71 and the second transport guide 82 are electrically conductive, the first transport guide 71 and the second transport guide 82 are hardly charged and hardly electrostatically attract toner, compared to the sixth comparative example.

Second Exemplary Embodiment

An image forming apparatus 200 according to a second exemplary embodiment will be described. Hereinafter, parts different from those in the first exemplary embodiment will be described, and parts identical to those in first exemplary embodiment are designated by the same reference numerals, and descriptions thereof will be appropriately omitted.

Figure 8:
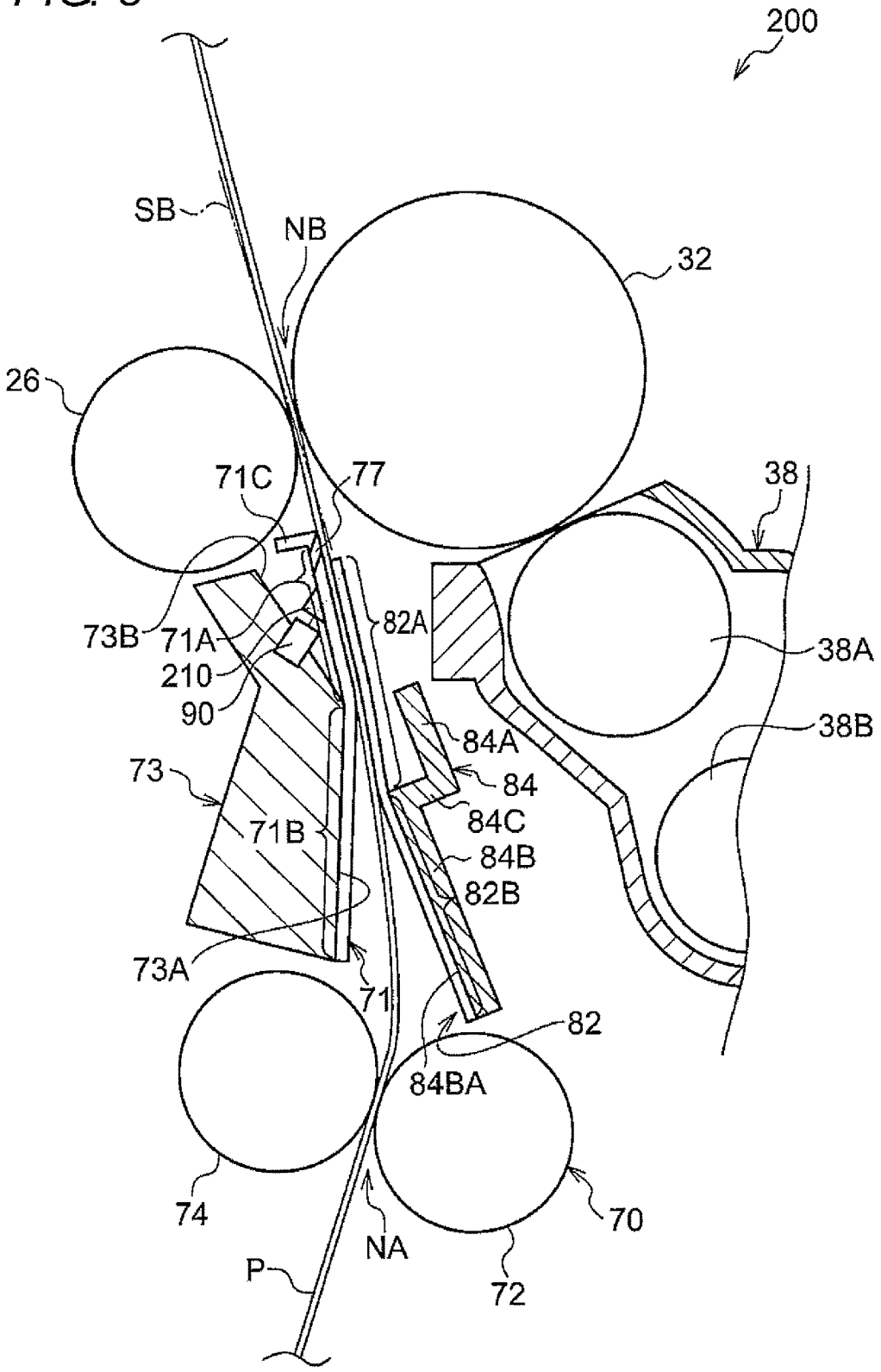
FIG. 8 is a schematic view illustrating a configuration between a photoconductor drum (transfer roll) and a registration roll pair according to a second exemplary embodiment.

As illustrated in FIG. 8, the image forming apparatus 200 includes a reference plate 210 which is provided at a position where the reference plate 210 blocks the optical path of the detection sensor 90 in a state in which the upper portion 71A of the first transport guide 71 is elastically deformed by being pressed by the non-transfer surface of the thick paper. In a case in which the paper P does not pass between the first transport guide 71 and the second transport guide 82 and the first transport guide 71 is not deformed, the reference plate 210 is located at a position where the reference plate 210 opens the optical path of the detection sensor 90 as illustrated in FIG. 9.

Further, the detection sensor 90 detects reflected light from the reference plate 210 in a state in which the upper portion 71A of the first transport guide 71 is deformed, and performs correction. As an example, the correction is carried out as follows. That is, in a state in which the upper portion 71A of the first transport guide 71 is elastically deformed by being pressed by the non-transfer surface of the thick paper, the detection sensor 90 detects the reflected light from the reference plate 210, a detection result is sent to the controller 20 as a reference plate output value, and the controller 20 stores the detection result.

Figure 9:
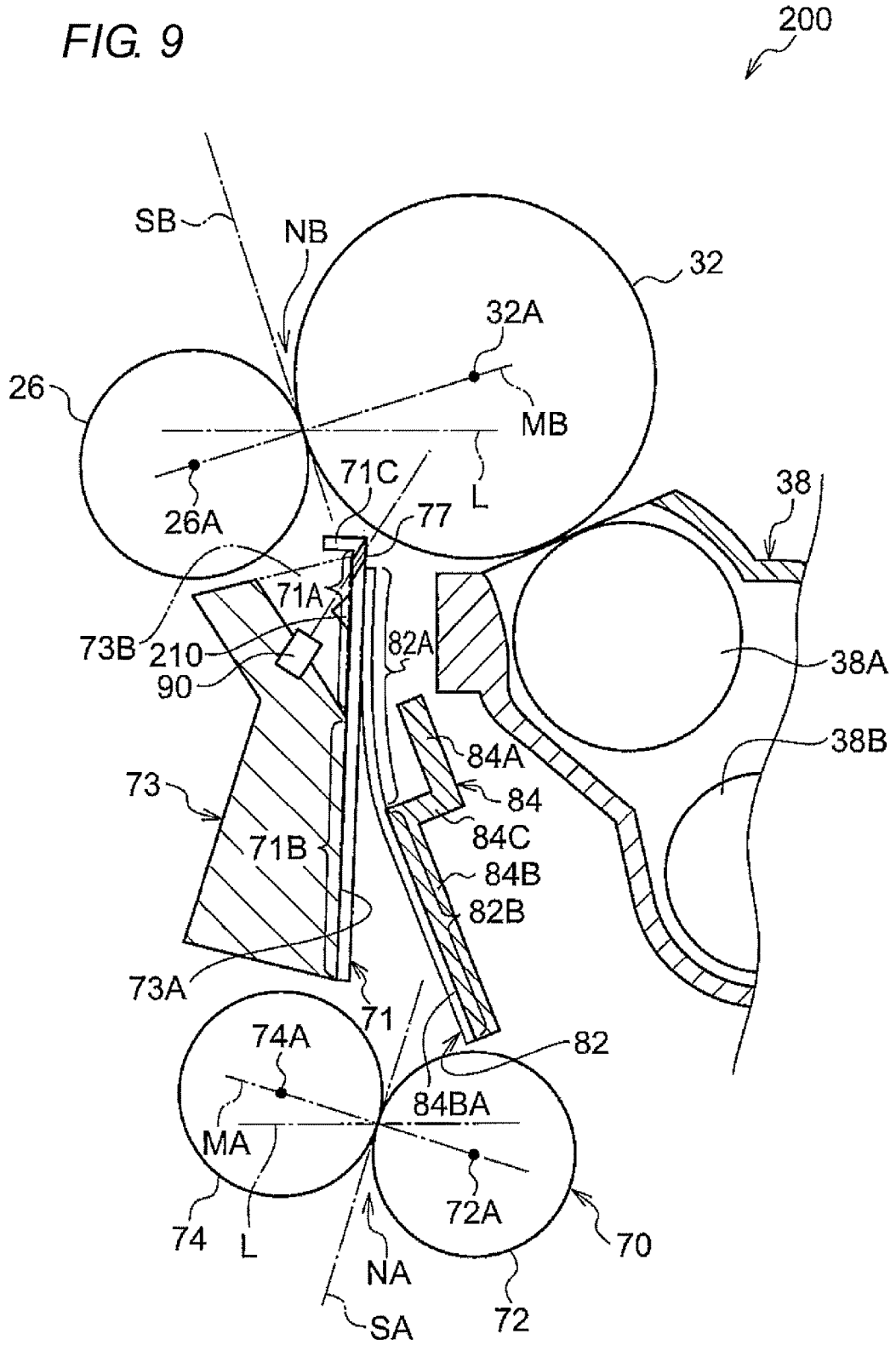
FIG. 9 is a schematic view illustrating a paper non-passing state in which no paper is transported in the configuration illustrated in FIG. 8.

As illustrated in FIG. 9, in a state in which the paper P does not pass between the first transport guide 71 and the second transport guide 82, the detection sensor 90 detects the toner patch on the photoconductor drum 32 on the optical path that passes through the through hole 77 of the first transport guide 71 in a state in which the first transport guide 71 is not deformed, and the detection result is sent to the controller 20 as a patch output value.

The controller 20 defines a ratio of the patch output value to the reference plate output value as an image density value, and controls the respective components of the image forming unit 14 based on a difference between the image density value and a target density value. That is, in the second exemplary embodiment, the respective components of the image forming unit 14 are controlled based on the image density value obtained based on the reference plate 210 of which the input amount to the detection sensor 90 is already known.

In addition, the reference plate may be used to adjust the amount of emitting light or the amount of receiving light of the detection sensor 90. Specifically, in order to make the reference plate output value constant, the image density value may be obtained by adjusting the amount of emitting light or the amount of receiving light of the detection sensor 90, and emitting and receiving light by the detection sensor 90 after the adjustment.

As described above, in the second exemplary embodiment, as the upper portion 71A of the first transport guide 71 is elastically deformed by being pressed by the non-transfer surface of the thick paper as illustrated in FIG. 8, the reference plate 210 is moved on the optical path of the detection sensor 90.

Therefore, a dedicated moving mechanism for moving the reference plate 210 on the optical path of the detection sensor 90 is not required, and the number of components is reduced, compared to a configuration which has a dedicated moving mechanism for moving the reference plate 210 (comparative example).

Third Exemplary Embodiment

An image forming apparatus 300 according to a third exemplary embodiment will be described. Hereinafter, parts different from those in the first exemplary embodiment will be described, and parts identical to those in first exemplary embodiment are designated by the same reference numerals, and descriptions thereof will be appropriately omitted.

Figure 10:
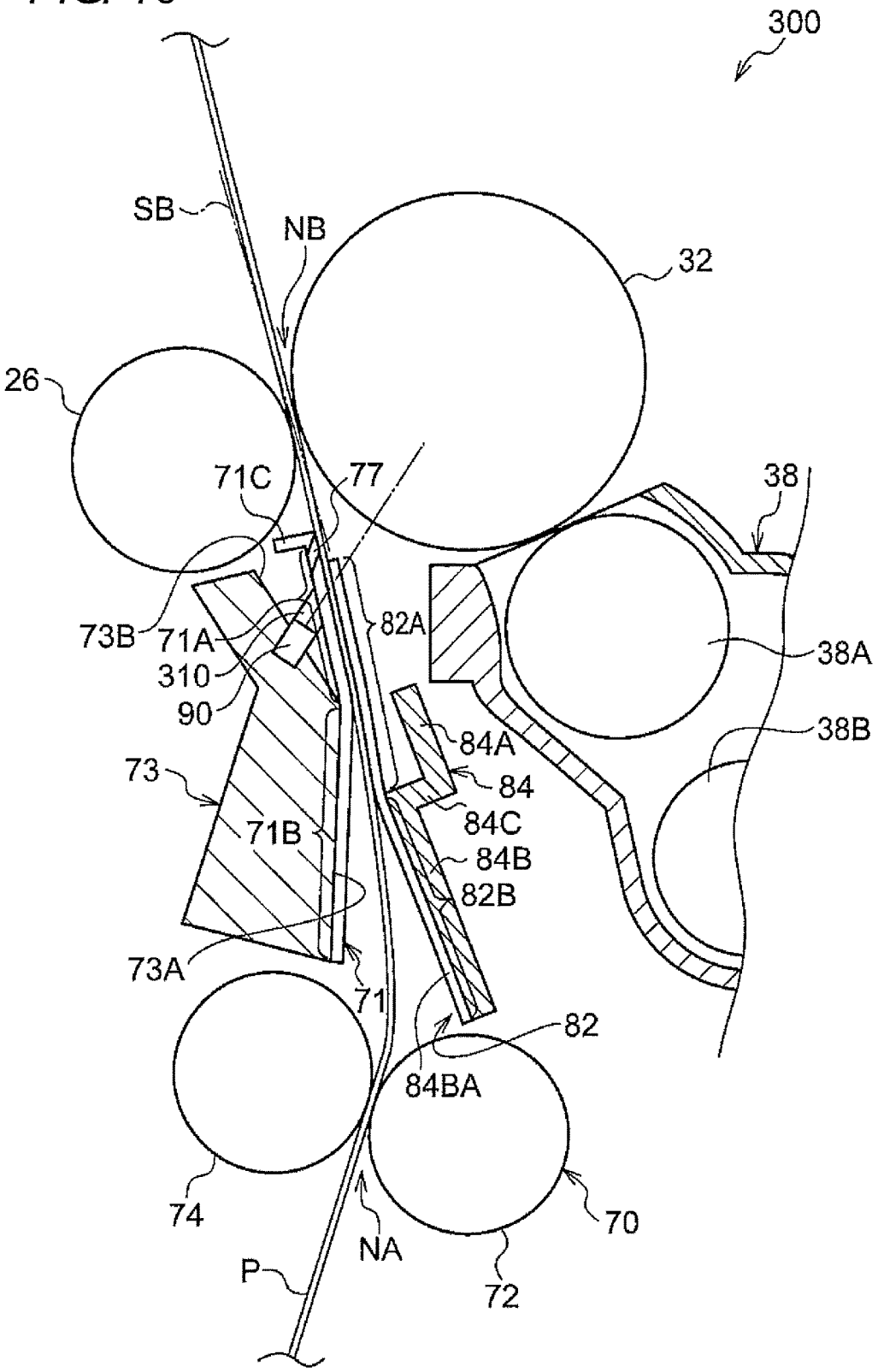
FIG. 10 is a schematic view illustrating a configuration between a photoconductor drum (transfer roll) and a registration roll pair according to a third exemplary embodiment.
Figure 11:
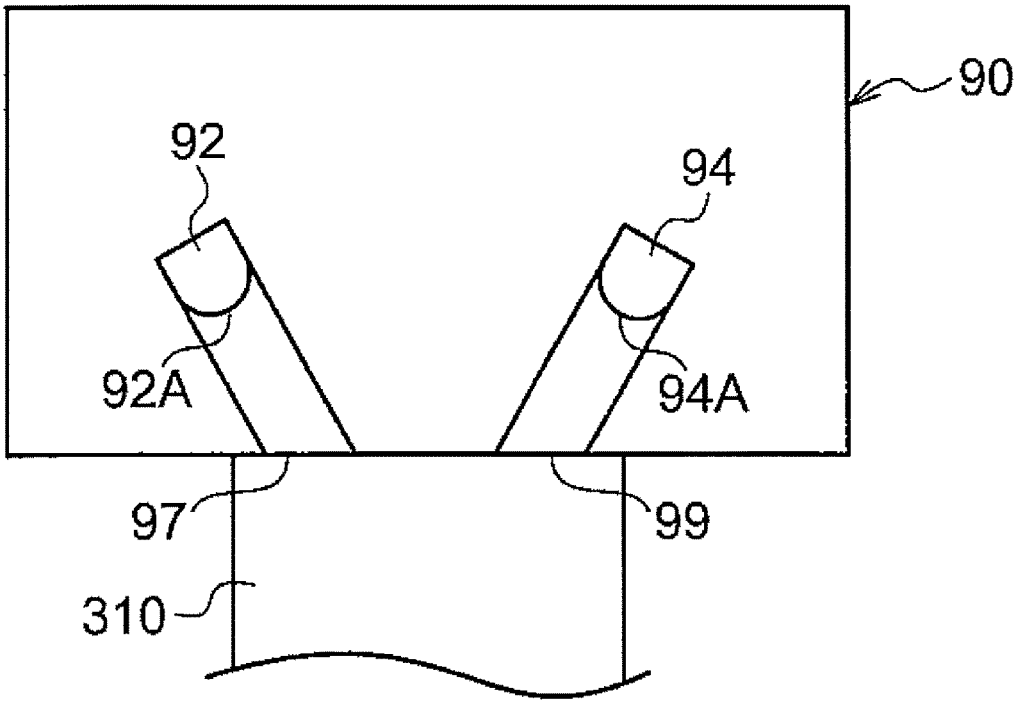
FIG. 11 is a schematic view illustrating a state in which a cleaning member is in contact with a detection sensor according to the third exemplary embodiment.
Figure 12:
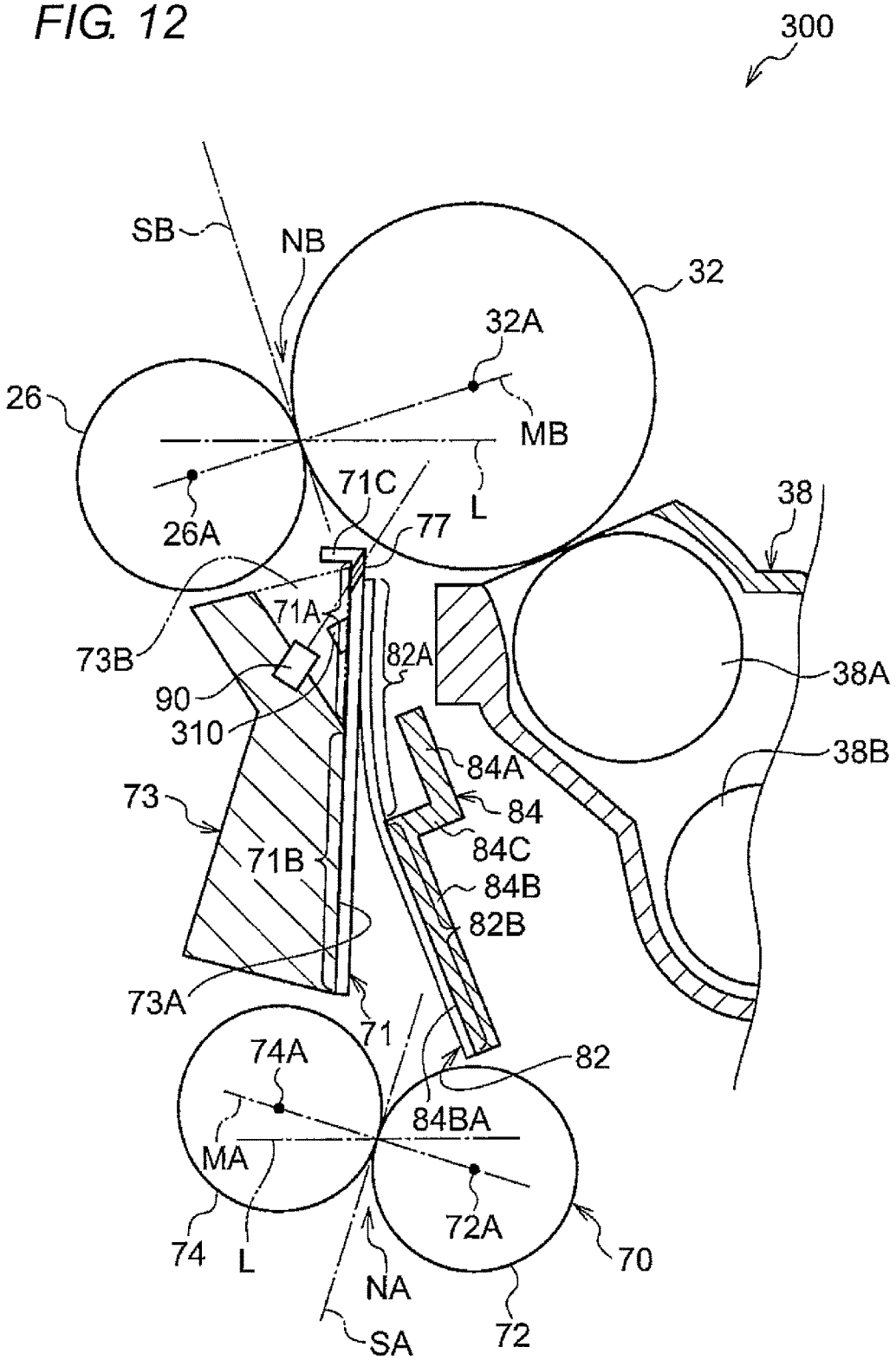
FIG. 12 is a schematic view illustrating a paper non-passing state in which no paper P is transported in the configuration illustrated in FIG. 10.

As illustrated in FIGS. 10 and 11, the image forming apparatus 300 includes a cleaning member 310 which comes into contact with and cleans the light emitting window 97 and the light receiving window 99 of the detection sensor 90 in a state in which the upper portion 71A of the first transport guide 71 is elastically deformed by being pressed by the non-transfer surface of the thick paper. In a case in which the paper P does not pass between the first transport guide 71 and the second transport guide 82 and the first transport guide 71 is not deformed, the cleaning member 310 is located at a position where the cleaning member 310 opens the optical path of the detection sensor 90 as illustrated in FIG. 12. For example, a foamed body (sponge), non-woven fabric, a brush, or the like is used as the cleaning member 310.

As described above, in the third exemplary embodiment, as illustrated in FIG. 10, as the upper portion 71A of the first transport guide 71 is elastically deformed by being pressed by the non-transfer surface of the thick paper, the cleaning member 310 moves on the light emitting window 97 and the light receiving window 99, and cleans the detection sensor 90.

Therefore, a dedicated moving mechanism for moving the cleaning member 310 on the light emitting window 97 and the light receiving window 99 of the detection sensor 90 is not required, and the number of components is reduced, compared to a configuration which has a dedicated moving mechanism for moving the cleaning member 310 (comparative example).

In addition, the cleaning member 310 may be configured to clean at least one of the light emitting window 97 and the light receiving window 99.

In addition, the detection sensor 90 includes the light emitting window 97 (an example of a light exit surface) from which light emitted from the irradiating unit 92 exits, and the light receiving window 99 (an example of light incident surface) through which the reflected light enters the light receiving unit 94, but is not limited thereto. For example, the detection sensor 90 may not include the light emitting window 97 and the light receiving window 99, and may have a configuration in which the irradiating surface 92A of the irradiating unit 92 and the light receiving surface 94A of the light receiving unit 94 are exposed. In this case, the irradiating surface 92A functions as an example of a light emitting surface to be cleaned, and the light receiving surface 94A functions as an example of a light incident surface to be cleaned.

(Modification Examples of First Transport Guide 71)

In FIGS. 13 to 21, modification examples of the first transport guide 71 are illustrated. In addition, in FIGS. 13 to 21, R1 indicates the irradiated light of the detection sensor 90, and R2 indicates the reflected light of the detection sensor 90.

Figure 13:
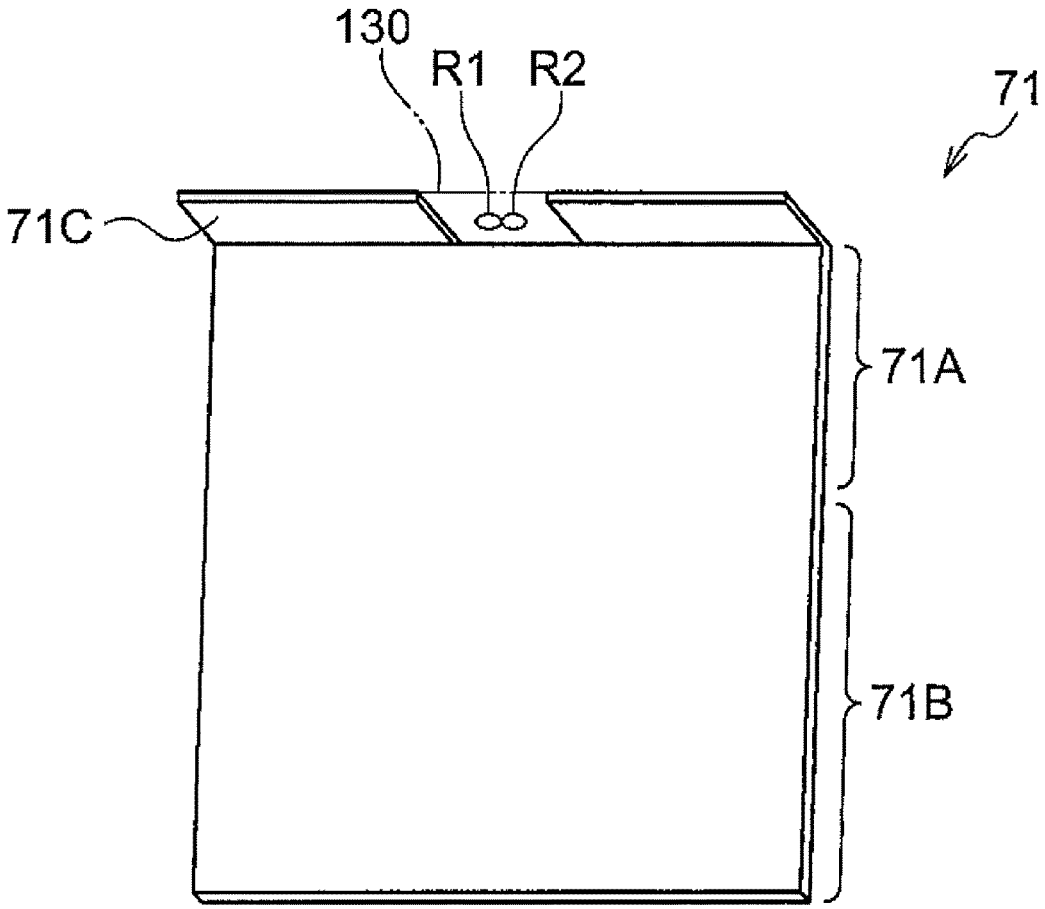
FIG. 13 is a schematic perspective view illustrating a first transport guide according to a modification example.

As illustrated in FIG. 13, a cutout portion 130 (an example of a cutout) through which the irradiated light R1 and the reflected light R2 of the detection sensor 90 pass may be formed in the bent portion 71C of the first transport guide 71. In the configuration illustrated in FIG. 13, the cutout portion 130 is formed at the central portion of the bent portion 71C in the width direction. The cutout portion 130 is formed from a front end (the left end in FIG. 2) of the bent portion 71C to a base end (the right end in FIG. 2).

According to the configuration illustrated in FIG. 13, since the cutout portion 130 is formed at the central portion of the bent portion 71C in the width direction, the first transport guide 71 including the bent portion 71C is suppressed from being elastically deformed in the biased manner at one end in the width direction, and the paper is suppressed from being obliquely transported, compared to the configuration in which the cutout portion 130 is formed only at one end in the width direction of the bent portion 71C (comparative example).

Here, in a configuration in which the cutout portion 130 is formed in the upper portion 71A (a portion that guides the paper P) of the first transport guide 71 (seventh comparative example), when the paper P does not cause friction with the cutout portion 130, and the paper P is charged by friction with the first transport guide 71, a friction charging amount may vary in the width direction of the paper P. When the friction charging amount varies in the width direction of the paper P, non-uniformity in transfer property of the toner image is caused in the width direction of the paper P.

In contrast, in the configuration illustrated in FIG. 13, the cutout portion 130 is formed in the bent portion 71C with which the trailing end of the paper P comes into contact, and the paper P, which is in contact with the bent portion 71C, is hardly charged by friction such that the friction charging amount hardly varies, compared to the seventh comparative example.

Figure 14:
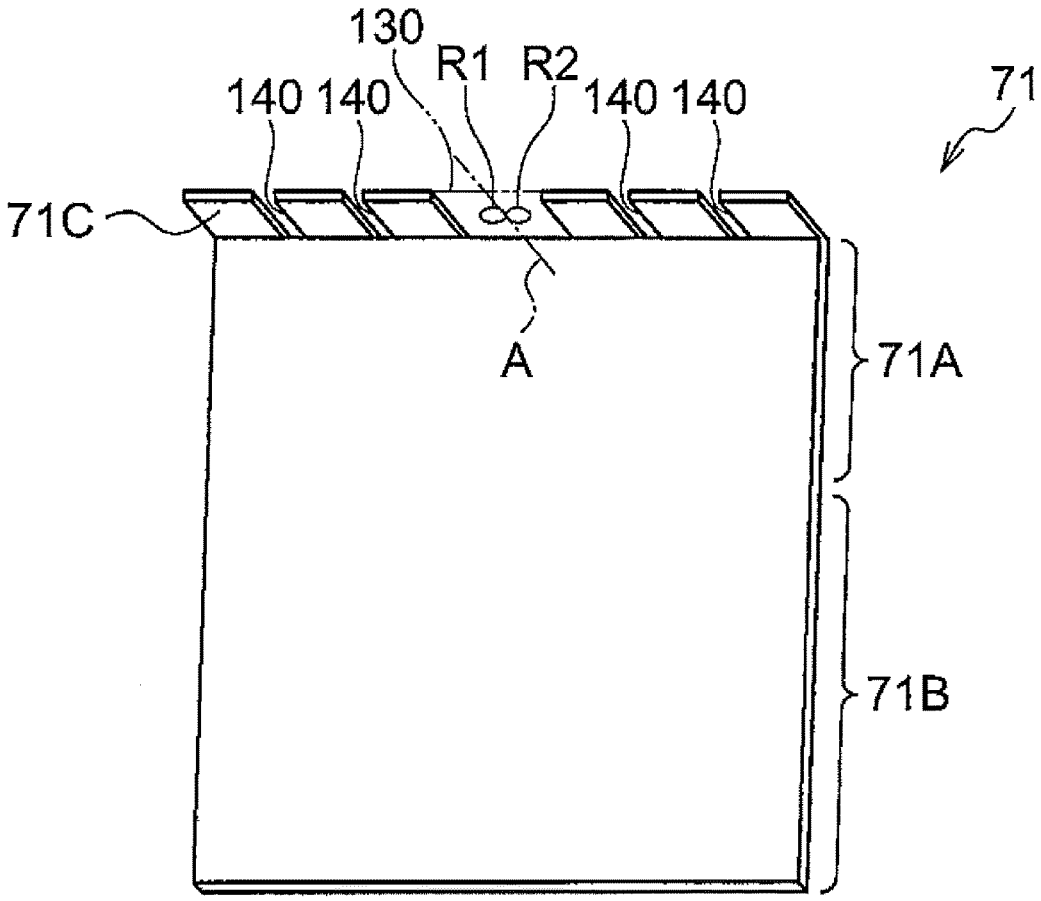
FIG. 14 is a schematic perspective view illustrating a first transport guide according to a modification example.

In the configuration in which the cutout portion 130 is formed at the central portion of the bent portion 71C in the width direction, plural slits 140 may be formed at one end of the bent portion 71C in the width direction and the other end of the bent portion 71C in the width direction, respectively, as illustrated in FIG. 14. The plural slits 140 is formed to be line-symmetrical about a line A as a symmetry axis, which passes through the center of the bent portion 71C in the width direction.

Therefore, even in a case in which the paper P, which has a width greater than a width of the cutout portion 130 and smaller than a width between the slits 140, passes through the first transport guide 71, the upper portion 71A and the bent portion 71C may be easily bent by contact between the trailing end of the paper P and the bent portion 71C, repulsive force applied to the paper from the first transport guide 71 is mitigated, and a difference in deflection amount caused by a difference in width of the paper is mitigated, compared to a configuration in which the first transport guide 71 with the bent portion 71C has a predetermined width (a configuration in which no slit 140 is formed).

Figure 15:
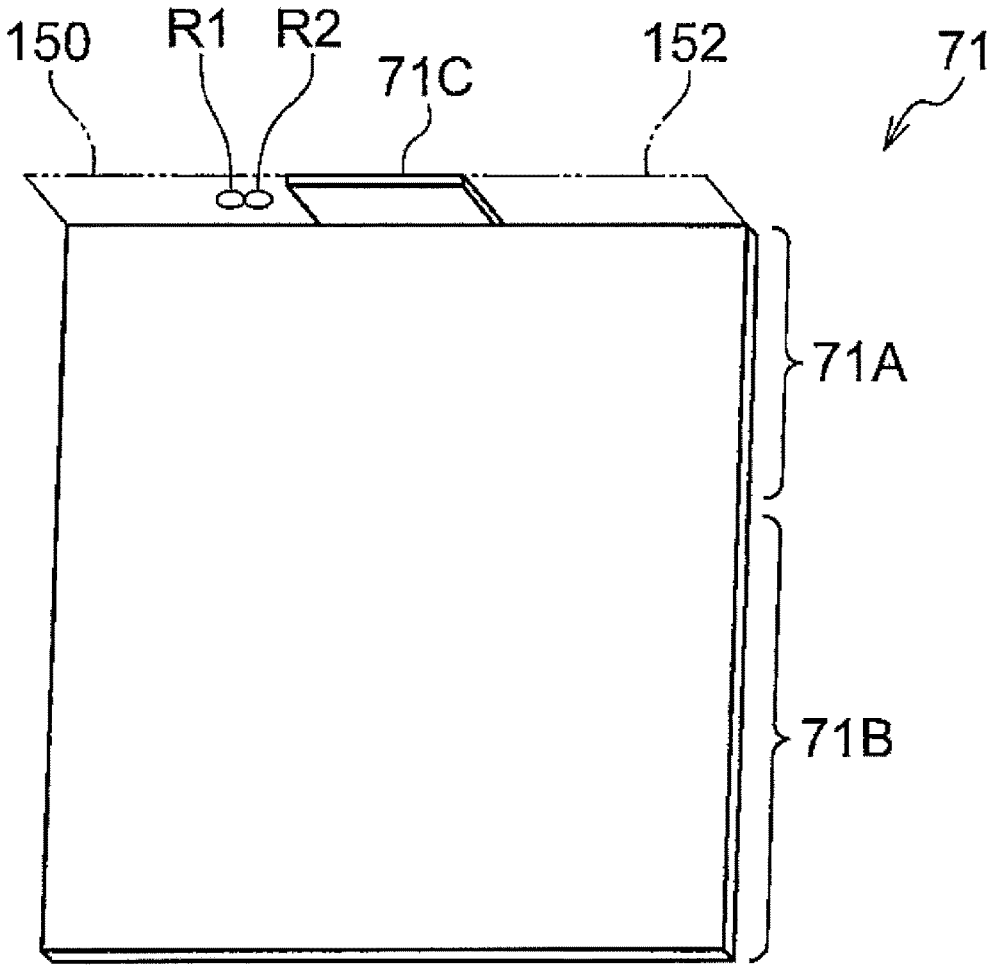
FIG. 15 is a schematic perspective view illustrating a first transport guide according to a modification example.

As illustrated in FIG. 15, a cutout portion 150 (an example of a cutout) through which the irradiated light R1 and the reflected light R2 of the detection sensor 90 pass may be formed at one end, in the width direction, of the bent portion 71C of the first transport guide 71. In the configuration illustrated in FIG. 15, a cutout portion 152 (an example of a cutout), which does not serve as a optical path of the detection sensor 90, is formed at the other end of the bent portion 71C in the width direction. The cutout portion 150 and the cutout portion 152 are formed from a front end (left end in FIG. 2) of the bent portion 71C to a base end (right end in FIG. 2).

According to the configuration illustrated in FIG. 15, since the cutout portion 150 and the cutout portion 152 are formed only at one end and the other end of the bent portion 71C in the width direction, respectively, the first transport guide 71 including the bent portion 71C is suppressed from being elastically deformed in the biased manner at one end in the width direction, and the paper is suppressed from being obliquely transported, in comparison with a configuration (comparative example) in which the cutout portion 150 is formed only on one side of the bent portion 71C in the width direction.

Figure 16:
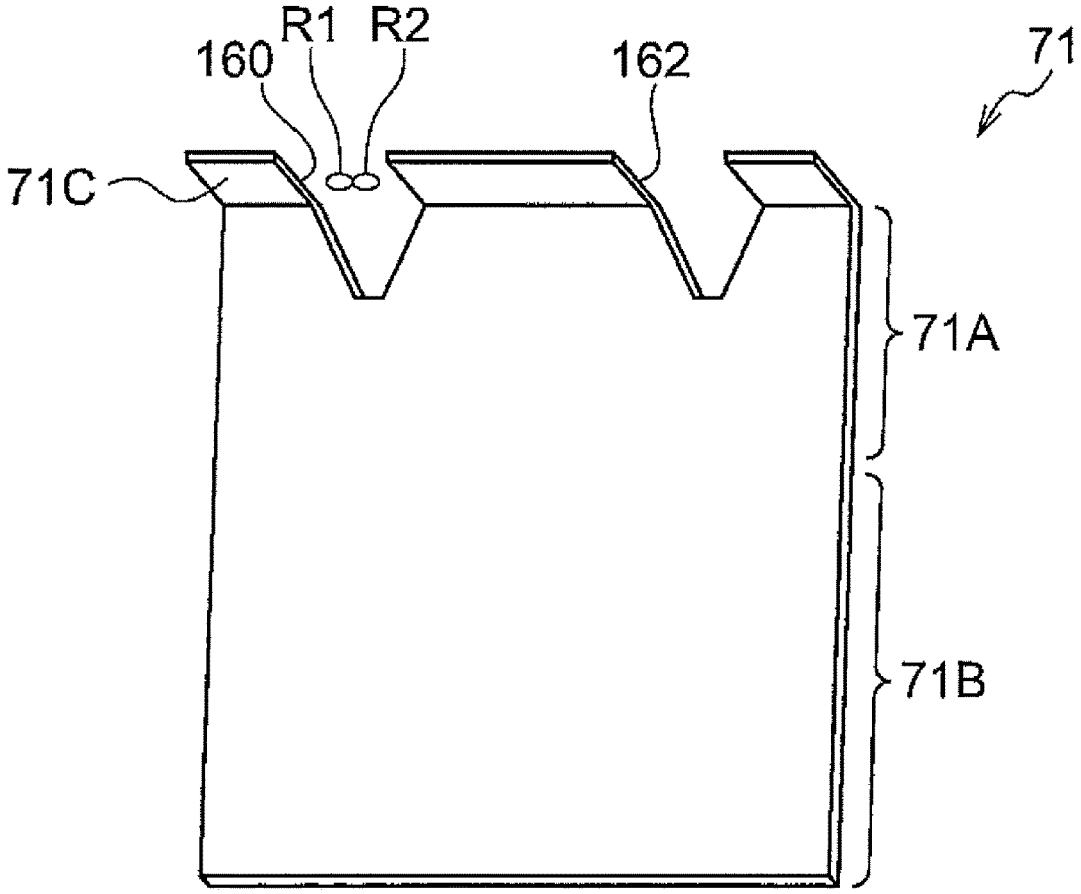
FIG. 16 is a schematic perspective view illustrating a first transport guide according to a modification example.

As illustrated in FIG. 16, the first transport guide 71 may be formed with the slits 160 and 162 at one end of the bent portion 71C in the width direction and at the other end of the bent portion 71C in the width direction. In the configuration illustrated in FIG. 16, the slits 160 and 162 reach the base end (right end in FIG. 2) from the front end (left end in FIG. 2) of the bent portion 71C, and are formed on an upper side of the upper portion 71A. Further, the irradiated light R1 and the reflected light R2 of the detection sensor 90 pass through a portion of the slit 160 which is formed in the bent portion 71C. That is, the slit 160 functions as an example of a cutout through which the irradiated light R1 and the reflected light R2 of the detection sensor 90 passes. The slit 162 functions as an example of a cutout that does not serve as a optical path of the detection sensor 90.

According to the configuration illustrated in FIG. 16, even in a case in which the paper P having a width smaller than a width between the slits 160 and 162 passes through the first transport guide 71, the upper portion 71A and the bent portion 71C may be easily bent by contact between the trailing end of the paper P and the bent portion 71C, repulsive force applied to the paper from the first transport guide 71 is mitigated, and a difference in deflection amount caused by a difference in width of the paper is mitigated, compared to a configuration in which the first transport guide 71 with the bent portion 71C has a predetermined width (a configuration in which the slits 160 and 162 are not formed).

Figure 17:
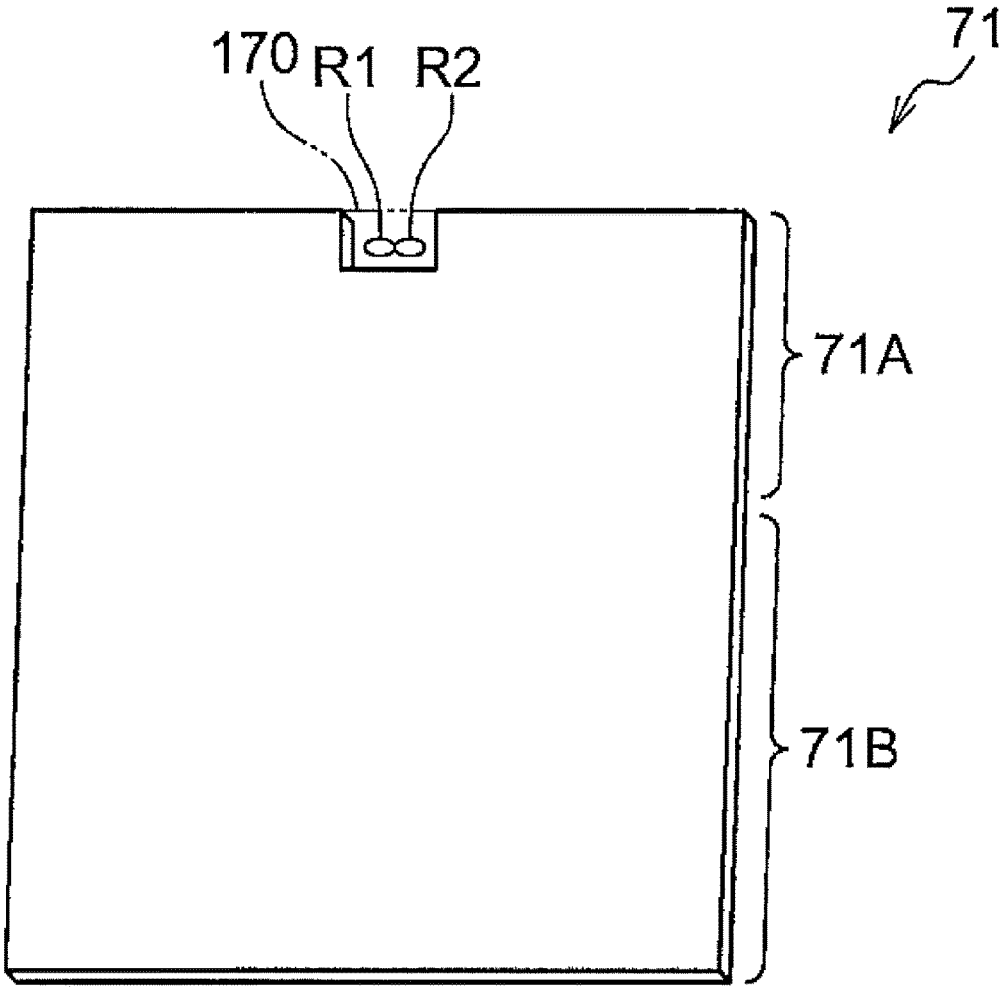
FIG. 17 is a schematic perspective view illustrating a first transport guide according to a modification example.
Figure 18:
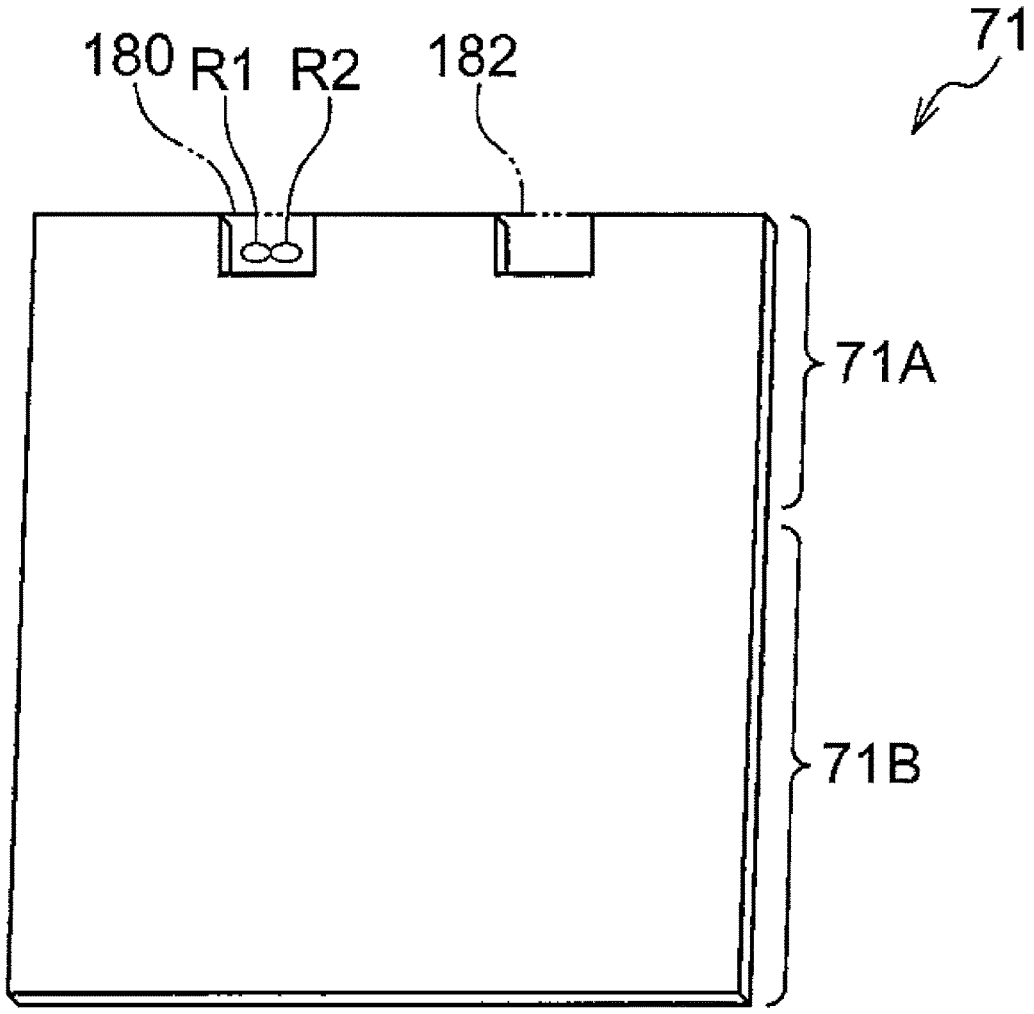
FIG. 18 is a schematic perspective view illustrating a first transport guide according to a modification example.

As illustrated in FIGS. 17 and 18, the first transport guide 71 may not have the bent portion 71C. In the configuration illustrated in FIG. 17, a cutout portion 170 (an example of a cutout) through which the irradiated light R1 and the reflected light R2 of the detection sensor 90 pass is formed at the central portion in the width direction at an upper end of the upper portion 71A.

In the configuration illustrated in FIG. 18, a cutout portion 180 through which the irradiated light R1 and the reflected light R2 of the detection sensor 90 pass is formed at one end in the width direction at an upper end of the upper portion 71A. A cutout portion 182 (an example of a cutout), which does not serve as a optical path of the detection sensor 90, is formed at the other end in the width direction at the upper end of the upper portion 71A.

Figure 19:
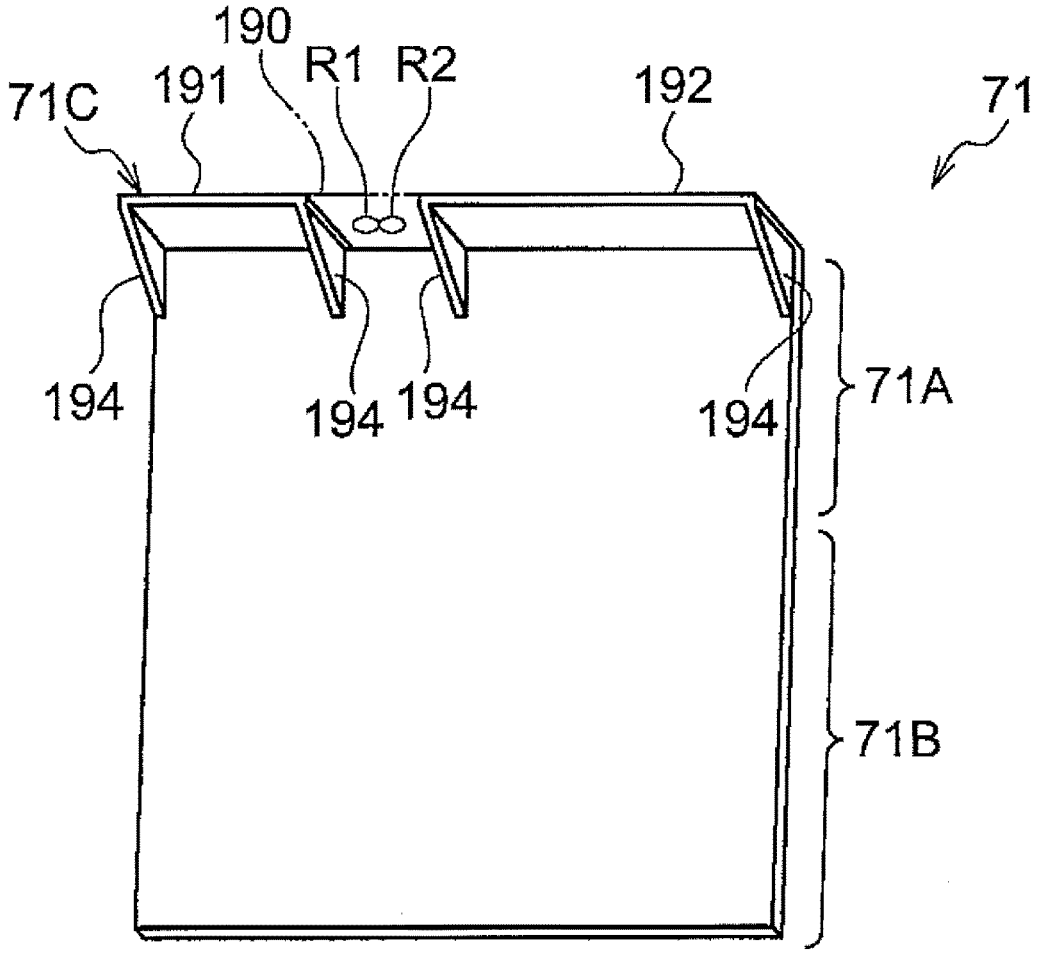
FIG. 19 is a schematic perspective view illustrating a first transport guide according to a modification example.
Figure 20:
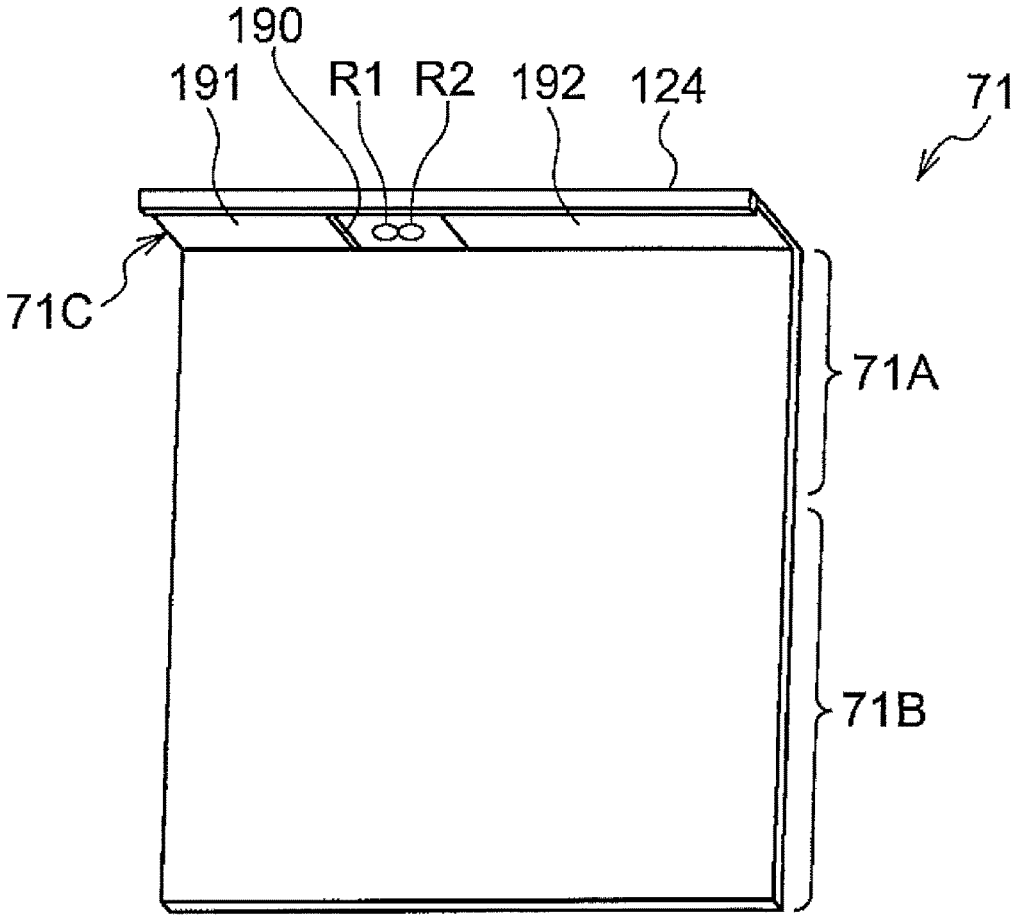
FIG. 20 is a schematic perspective view illustrating a first transport guide according to a modification example.
Figure 21:
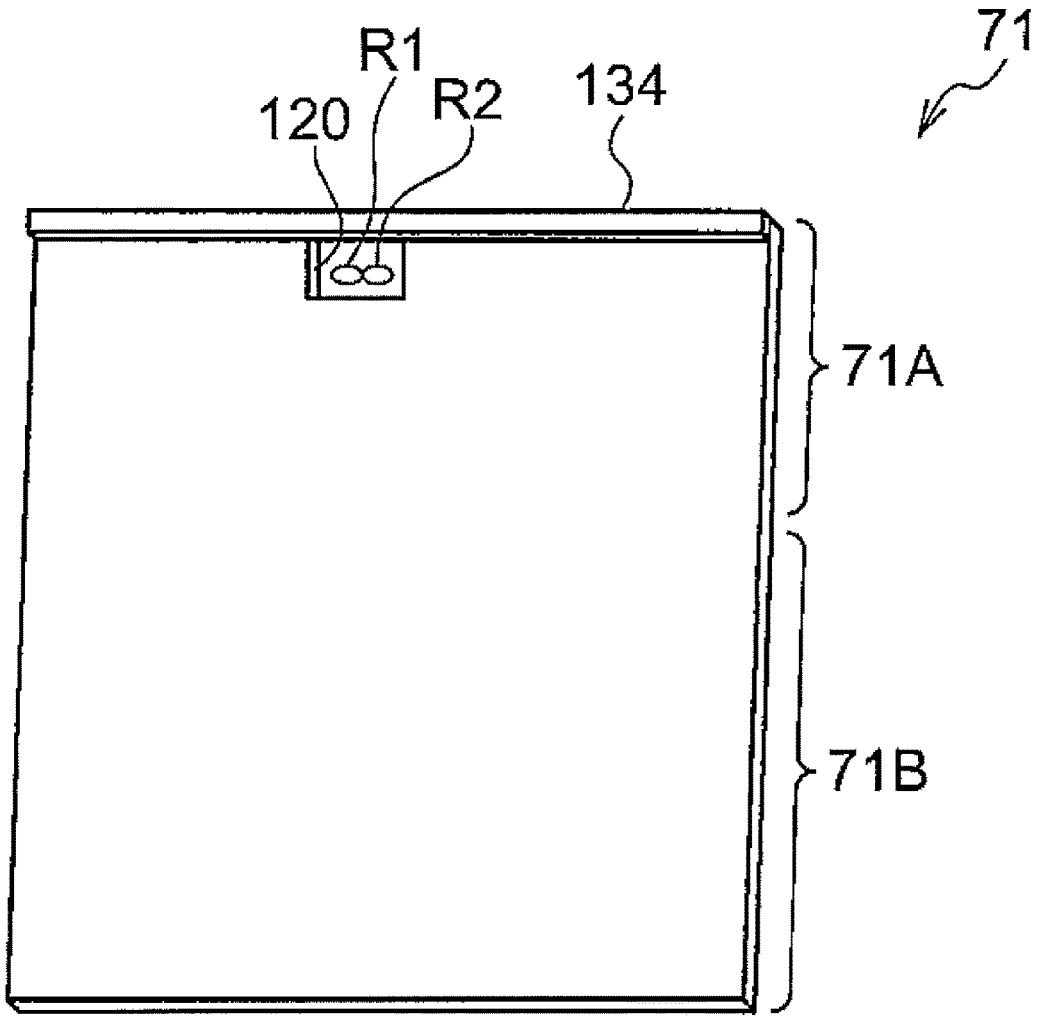
FIG. 21 is a schematic perspective view illustrating a first transport guide according to a modification example.

As illustrated in FIGS. 19, 20, and 21, the first transport guide 71 may be configured to have reinforcing members 194, 124, and 134 made of a rigid body.

In the configurations illustrated in FIGS. 19 and 20, a cutout portion 190 (an example of a cutout) through which the irradiated light R1 and the reflected light R2 of the detection sensor 90 pass is formed at a position which deviates from a center of the bent portion 71C in the width direction to one end of the bent portion 71C in the width direction. The cutout portion 190 is formed from the front end (left end in FIG. 2) of the bent portion 71C to the base end (right end in FIG. 2). As the cutout portion 190 is formed, the bent portion 71C is divided into one end portion 191 which is disposed at one end in the width direction, and the other end portion 192 which is disposed at the other end in the width direction and has a longer length in the width direction than the one end portion 191.

The reinforcing members 194 illustrated in FIG. 19 are provided at both ends of the one end portion 191 in the width direction and at both ends of the other end portion 192 in the width direction, respectively. The reinforcing members 194 are each formed in a plate shape and in a triangular shape when viewed in the width direction of the first transport guide 71. The reinforcing member 194 is fixed to the lower end of the bent portion 71C and the upper portion 71A, thereby suppressing the one end portion 191 and the other end portion 192 from being elastically deformed downward.

The reinforcing member 124 illustrated in FIG. 20 is formed in a bar shape along the width direction of the first transport guide 71. The reinforcing member 124 is fixed to front ends of the one end portion 191 and the other end portion 192 (left ends in FIG. 2). The reinforcing member 124 suppresses one of the one end portion 191 and the other end portion 192 from being elastically deformed in the biased manner.

In the configuration illustrated in FIG. 21, the first transport guide 71 has no bent portion 71C. In addition, a cutout portion 120 (an example of a cutout) through which the irradiated light R1 and the reflected light R2 of the detection sensor 90 pass is formed at a position which deviates from a center in the width direction to one end in the width direction at an upper end of the upper portion 71A of the first transport guide 71.

The reinforcing member 134 illustrated in FIG. 21 is formed in a bar shape in the width direction of the first transport guide 71. The reinforcing member 124 is fixed to an upper end of the upper portion 71A. The reinforcing member 134 suppresses the upper end of the upper portion 71A from being elastically deformed in the biased manner in the width direction.

As described above, since the configurations illustrated in FIGS. 19, 20, and 21 have the reinforcing members 194, 124, and 134, the first transport guide 71 is suppressed from being elastically deformed in the biased manner in the width direction, even in a case in which the cutout portions 190 and 120 are formed at the positions that deviate to one end in the width direction from a center in the width direction of the first transport guide 71. For this reason, the paper P is suppressed from skewing.

(Another Modification Example)

In the above described first, second, and third exemplary embodiments, the second transport guide 82 is configured to be elastically deformable, but is not limited thereto. For example, the second transport guide 82 may be configured with a rigid body that is not elastically deformed.

In the aforementioned first, second, and third exemplary embodiments, the transfer roll 26 is used as a transfer body, but is not limited thereto. A transfer belt may be used as a transfer body.

In the aforementioned first, second, and third exemplary embodiments, the detection sensor 90 is used to detect an image density, but is not limited thereto. For example, in a case in which the image carrier is an intermediate transfer body, the detection sensor, which is used to adjust a position of an image, may be used as a device of detecting positions of respective color images formed on the intermediate transfer body. That is, in the first, second, and third exemplary embodiments, the detection sensor 90 may be an optical sensor for detecting an image.

The present invention is not limited to the aforementioned exemplary embodiments, and may be variously modified, changed, and altered without departing from the gist of the present invention. For example, the plural modification examples may be appropriately configured by being combined.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image;

a transfer body that transports a recording medium in a contact region between the image carrier and the transfer body with the recording medium being interposed therebetween, and transfers the image to the recording medium;

a pair of transport members that are disposed upstream of the contact region in a transport direction, and transport the recording medium to the contact region;

a guide member that comprises, between the contact region and the pair of transport members, a portion on a downstream side in the transport direction which serves as a free end portion and a portion on an upstream side in the transport direction which is supported in a cantilever state, that guides a non-transfer surface of the recording medium, that is elastically deformed toward the transfer body with respect to the image carrier by being pushed by the non-transfer surface of the recording medium, and that has a cutout; and a detection unit that is disposed on an opposite side to the image carrier with respect to the guide member, and that detects an image on an outer peripheral surface of the image carrier on an optical path that passes through the cutout of the guide member in a non-deformed state.

2. The image forming apparatus according to claim 1, wherein the cutout is formed at a central portion of the guide member in a width direction.

3. The image forming apparatus according to claim 1, wherein the cutout is formed at one end of the guide member in a width direction, and wherein another cutout, which does not serve as an optical path, is formed at another end of the guide member in the width direction.

4. The image forming apparatus according to claim 1, wherein a bent portion bent toward the transfer body with respect to the image carrier is formed at an end portion of the guide member on the downstream side in the transport direction, and wherein the cutout is formed in the bent portion.

5. The image forming apparatus according to claim 2, wherein a bent portion bent toward the transfer body with respect to the image carrier is formed at an end portion of the guide member on the downstream side in the transport direction, and wherein the cutout is formed in the bent portion.

6. The image forming apparatus according to claim 3, wherein a bent portion bent toward the transfer body with respect to the image carrier is formed at an end portion of the guide member on the downstream side in the transport direction, and wherein the cutout is formed in the bent portion.

7. The image forming apparatus according to claim 1, wherein the guide member blocks the optical path in a state in which the guide member is elastically deformed.

8. The image forming apparatus according to claim 2, wherein the guide member blocks the optical path in a state in which the guide member is elastically deformed.

9. The image forming apparatus according to claim 3, wherein the guide member blocks the optical path in a state in which the guide member is elastically deformed.

10. The image forming apparatus according to claim 4, wherein the guide member blocks the optical path in a state in which the guide member is elastically deformed.

11. The image forming apparatus according to claim 5, wherein the guide member blocks the optical path in a state in which the guide member is elastically deformed.

12. The image forming apparatus according to claim 6, wherein the guide member blocks the optical path in a state in which the guide member is elastically deformed.

13. The image forming apparatus according to claim 1, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

14. The image forming apparatus according to claim 2, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

15. The image forming apparatus according to claim 3, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

16. The image forming apparatus according to claim 4, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

17. The image forming apparatus according to claim 5, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

18. The image forming apparatus according to claim 6, further comprising:

a reference plate that is provided at a position where the reference plate blocks the optical path in a state in which the guide member is elastically deformed, wherein the detection unit detects reflected light from the reference plate in the state in which the guide member is elastically deformed, and performs correction.

19. The image forming apparatus according to claim 1, further comprising:

a cleaning member that contacts and cleans at least one of a light exit surface of the detection unit from which light exits and a light incident surface through which light enters, in a state in which the guide member is elastically deformed.

20. The image forming apparatus according to claim 2, further comprising:

a cleaning member that contacts and cleans at least one of a light exit surface of the detection unit from which light exits and a light incident surface through which light enters, in a state in which the guide member is elastically deformed.

* * * * *